US012751560B1

(12) United States Patent
Kervina et al.

(10) Patent No.: US 12,751,560 B1
(45) Date of Patent: Oct. 6, 2026

(54) CUSTOMIZED MATTRESS SYSTEM WITH HYBRID ELEMENTS

(71) Applicant: Mattai SA, Lugano (CH)

(72) Inventors: Gregor Kervina, Ljubljana (SI); Sandi Češko, Izlake (SI); Boris Ribičič, Ijubljana (SI)

(73) Assignee: Mattai SA, Lugano (CH)

( * ) Notice: Subject to any disclaimer, the term of this patent is extended or adjusted under 35 U.S.C. 154(b) by 15 days.

(21) Appl. No.: 18/663,434

(22) Filed: May 14, 2024

(51) Int. Cl.

| | |
|---|---|
| ***A47C 31/12*** | (2006.01) |
| ***A47C 27/06*** | (2006.01) |
| ***A47C 27/08*** | (2006.01) |
| ***A47C 27/10*** | (2006.01) |
| ***A47C 31/00*** | (2006.01) |

(52) U.S. Cl.
CPC ..... *A47C 31/123* (2013.01); *A47C 27/064* (2013.01); *A47C 27/066* (2013.01); *A47C 27/082* (2013.01); *A47C 27/083* (2013.01); *A47C 27/10* (2013.01); *A47C 31/007* (2013.01); *A47C 31/126* (2013.01)

(58) Field of Classification Search
CPC ..... A47C 27/083; A47C 27/082; A47C 27/10
See application file for complete search history.

(56) References Cited

U.S. PATENT DOCUMENTS 3,919,730 A * 11/1975 Regan ..... A61G 7/05776 601/111
4,762,231 A * 8/1988 Kiselewski ..... A45C 13/021 206/522
4,827,546 A * 5/1989 Cvetkovic ..... A47C 31/123 297/DIG. 8
4,852,195 A * 8/1989 Schulman ..... A61G 7/05776 297/DIG. 8
5,113,539 A 5/1992 Strell
(Continued)

FOREIGN PATENT DOCUMENTS

CN 117530562 A * 2/2024 ..... A47C 27/06
WO 2016138082 A1 9/2016

OTHER PUBLICATIONS

Translation CN-117530562-A (Year: 2025).*
(Continued)

*Primary Examiner* — J. T. Newton
(74) *Attorney, Agent, or Firm* — Murphy, Bilak & Homiller, PLLC

(57) ABSTRACT

A mattress, pillow or seat cushion customization system utilizes an adjustable "test mattress/cushion" comprising an array of hybrid elements, each element having an independently inflatable bladder. By receiving user input for desired firmness of different zones and adjusting the fluid pressure or volume of the inflatable bladders, the system allows a user to customize the compression stress-strain characteristics to their preferences. A data model representing the customized characteristics is then generated and transmitted to a manufacturing system for production of a personalized non-adjustable mattress matching the user's specifications. The system can incorporate an initial interactive questionnaire, analysis of user body dimensions, and a variety of deployment models to enable customized mattress manufacturing with a streamlined online ordering model.

18 Claims, 22 Drawing Sheets

(56) References Cited

U.S. PATENT DOCUMENTS

| | | | | |
|---|---|---|---|---|
| 5,201,780 | A * | 4/1993 | Dinsmoor, III | A61G 7/05715 5/679 |
| 5,421,044 | A * | 6/1995 | Steensen | A47C 27/18 5/713 |
| 5,425,147 | A * | 6/1995 | Supplee | A47C 20/026 5/713 |
| 5,586,348 | A * | 12/1996 | Toivio | A61G 7/05776 5/713 |
| 5,815,864 | A * | 10/1998 | Sloop | A61G 7/05769 5/713 |
| 5,836,027 | A | 11/1998 | Leventhal et al. | |
| 7,409,735 | B2 * | 8/2008 | Kramer | A61G 7/015 5/709 |
| 7,571,504 | B2 * | 8/2009 | Kuo | A47C 27/15 5/724 |
| 8,090,478 | B2 * | 1/2012 | Skinner | A47C 27/08 5/713 |
| 8,607,391 | B2 * | 12/2013 | Poppe | A47C 27/053 5/636 |
| 8,863,336 | B2 * | 10/2014 | Theosabrata | A47C 27/082 5/655.5 |
| 8,973,193 | B2 * | 3/2015 | Codos | A47C 27/083 5/713 |
| 9,072,390 | B2 | 7/2015 | Poppe | |
| D736,543 | S | 8/2015 | Bramm | |
| 10,182,662 | B2 | 1/2019 | Duwell et al. | |
| 10,945,911 | B2 * | 3/2021 | Perriard | A43B 7/1464 |
| 11,058,227 | B2 * | 7/2021 | Thomas | A47C 27/062 |
| 11,661,989 | B2 | 5/2023 | Cesko et al. | |
| 2004/0045090 | A1 * | 3/2004 | Tsai | A61G 7/05707 5/709 |
| 2008/0052837 | A1 * | 3/2008 | Blumberg | A47C 27/10 600/300 |
| 2008/0109965 | A1 * | 5/2008 | Mossbeck | A47C 27/061 5/713 |
| 2010/0043148 | A1 * | 2/2010 | Rose | A47C 27/18 5/711 |
| 2011/0289691 | A1 * | 12/2011 | Lafleche | A47C 27/10 5/713 |
| 2015/0059100 | A1 * | 3/2015 | Brubaker | A61G 7/05738 5/713 |
| 2015/0351982 | A1 * | 12/2015 | Krenik | A47C 23/06 5/616 |
| 2018/0255937 | A1 * | 9/2018 | Longman | A47C 27/061 |
| 2023/0181396 | A1 * | 6/2023 | Bertoni | A61G 7/018 5/710 |

OTHER PUBLICATIONS

International Standard ISO 3386-2, second edition, Jun. 15, 1997 "Flexible cellular polymeric materials—Determination of stress-strain characteritics in compression".

Unknown, Author, "International Standard ISO-3386-2 Second Edition", Flexible Cellular Polymeric Materials—Determination of Stress-strain Characteristics in Compression; Part 2: High-density materials, Jun. 15, 1997, 1-8.

* cited by examiner

400

| Row | 1 | 2 | 3 | 4 | 5 | 6 | 7 | 8 | 9 |
|---|---|---|---|---|---|---|---|---|---|
| Foam A | 0 | 3 | 6 | 8 | 8 | 6 | 3 | 0 | |
| Foam B | 0 | 7 | 5 | 4 | 4 | 5 | 7 | 0 | |
| Foam C | 0 | 3 | 1 | 0 | 0 | 0 | 1 | 3 | 0 |
| Foam D | 17 | 4 | 5 | 5 | 5 | 5 | 5 | 4 | 17 |
| Foam E | 17 | 17 | 17 | 17 | 17 | 17 | 17 | 17 | 17 |

| Row | 1 | 2 | 3 | 4 | 5 | 6 | 7 | 8 | 9 |
|---|---|---|---|---|---|---|---|---|---|
| Foam A | 0 | 2 | 5 | 7 | 7 | 7 | 5 | 2 | 0 |
| Foam B | 0 | 8 | 6 | 5 | 5 | 5 | 6 | 8 | 0 |
| Foam C | 0 | 3 | 1 | 0 | 0 | 0 | 1 | 3 | 0 |
| Foam D | 17 | 4 | 5 | 5 | 5 | 5 | 5 | 4 | 17 |
| Foam E | 17 | 17 | 17 | 17 | 17 | 17 | 17 | 17 | 17 |

| Row | 1 | 2 | 3 | 4 | 5 | 6 | 7 | 8 | 9 |
|---|---|---|---|---|---|---|---|---|---|
| Foam A | 0 | 6 | 2 | 0 | 0 | 0 | 2 | 6 | 0 |
| Foam B | 0 | 0 | 1 | 3 | 3 | 3 | 1 | 0 | 0 |
| Foam C | 0 | 5 | 9 | 9 | 9 | 9 | 9 | 5 | 0 |
| Foam D | 17 | 6 | 5 | 5 | 5 | 5 | 5 | 6 | 17 |
| Foam E | 17 | 17 | 17 | 17 | 17 | 17 | 17 | 17 | 17 |

| Row | 1 | 2 | 3 | 4 | 5 | 6 | 7 | 8 | 9 |
|---|---|---|---|---|---|---|---|---|---|
| Foam A | 0 | 6 | 2 | 0 | 0 | 0 | 2 | 6 | 0 |
| Foam B | 0 | 0 | 1 | 3 | 3 | 3 | 1 | 0 | 0 |
| Foam C | 0 | 4 | 8 | 9 | 9 | 9 | 8 | 4 | 0 |
| Foam D | 17 | 7 | 6 | 5 | 5 | 5 | 6 | 7 | 17 |
| Foam E | 17 | 17 | 17 | 17 | 17 | 17 | 17 | 17 | 17 |

420

428

| Row | 1 | 2 | 3 | 4 | 5 | 6 | 7 | 8 | 9 | 10 | 11 | # | 13 | 14 | 15 | 16 | 17 | # |
|---|---|---|---|---|---|---|---|---|---|---|---|---|---|---|---|---|---|---|
| Foam A | 0 | 7 | 3 | 0 | 0 | 0 | 4 | 8 | 0 | 0 | 2 | 6 | 8 | 8 | 8 | 6 | 2 | 0 |
| Foam B | 0 | 0 | 1 | 3 | 3 | 3 | 1 | 0 | 0 | 0 | 10 | 7 | 5 | 5 | 5 | 6 | 9 | 0 |
| Foam C | 0 | 5 | 9 | 10 | 10 | 10 | 9 | 5 | 9 | 9 | 3 | 1 | 0 | 0 | 0 | 1 | 3 | 0 |
| Foam D | 18 | 6 | 5 | 5 | 5 | 5 | 4 | 5 | 9 | 9 | 3 | 4 | 5 | 5 | 5 | 5 | 4 | 18 |
| Foam E | 18 | 18 | 18 | 18 | 18 | 18 | 18 | 18 | 18 | 18 | 18 | 18 | 18 | 18 | 18 | 18 | 18 | 18 |

424

| Row | 1 | 2 | 3 | 4 | 5 | 6 | 7 | 8 | 9 | # | 11 | # | # | 15 | # | 17 | # |
|---|---|---|---|---|---|---|---|---|---|---|---|---|---|---|---|---|---|
| Foam A | 0 | 3 | 6 | 3 | 3 | 3 | 6 | 3 | 0 | 0 | 8 | 3 | 0 | 0 | 0 | 2 | 7 | 0 |
| Foam B | 0 | 8 | 6 | 4 | 4 | 4 | 7 | 9 | 0 | 0 | 0 | 1 | 3 | 3 | 3 | 1 | 0 | 0 |
| Foam C | 0 | 3 | 1 | 0 | 0 | 0 | 1 | 3 | 9 | 9 | 4 | 9 | 10 | 10 | 10 | 9 | 4 | 0 |
| Foam D | 18 | 4 | 5 | 5 | 5 | 5 | 4 | 3 | 9 | 9 | 6 | 5 | 5 | 5 | 5 | 6 | 7 | 18 |
| Foam E | 18 | 18 | 18 | 18 | 18 | 18 | 18 | 18 | 18 | 18 | 18 | 18 | 18 | 18 | 18 | 18 | 18 | 18 |

CUSTOMIZED MATTRESS SYSTEM WITH HYBRID ELEMENTS

RELATED APPLICATIONS

There are no previously filed, nor currently any co-pending applications, anywhere in the world.

BACKGROUND OF THE INVENTION

1. Field of the Invention

The present invention relates generally to adjustable bedding and seating systems and, more particularly, to an adjustable system with hybrid elements containing inflatable bladders, capable of creating zones having different firmness and support factor levels for a customizable experience and for use in personalized, customized mattress and furniture manufacturing.

2. DESCRIPTION OF THE RELATED ART

Customization of products to fit consumer's needs is highly popular in recent years. Today, even complex products that include multiple materials and parts may also be customized, leading to a wide range of customization options for consumers. However, the wider the range of customization options for a given product is, the harder it is for manufacturers to hold all possible product varieties in their warehouses or stores. As a result, product manufacturers prefer an on-demand, made-to-order manufacturing of customized products, rather than manufacturing and holding a large number of product varieties in warehouses before orders are made. Coupled with recent trends of shopping online, the demand for customized products is increasingly growing.

Built upon what a consumer can see on a computer monitor, online stores entice purchasing decisions with imagery, star ratings, and posted consumer reviews. Looking good in the consumer's home, however, may be one function of a product. Many products, such as furniture, must also feel comfortable so shopping also includes a tactile component. Shopping online and selecting a prepackaged furniture does not allow a consumer the opportunity to feel furniture, such as a mattress, and determine if the mattress would be comfortable. Providing visual, rather than tactile, experiences, a consumer wanting a comfortable mattress will leave the online store and enter a brick-and-mortar store.

In some situations, the online retailer may operate the brick-and-mortar store. In such an application, the firmness of the mattress, seat, cushion, pillow or other upholstered furniture piece can be manually tested by the consumer during use in the brick-and-mortar store and selected to suit their preferences. Therefore, it is desirable to present as many varieties of products to the consumer as possible in the brick-and-mortar store, so that the consumer can choose between various products having different tactile experiences. This leads to large stores holding a lot of inventory, resulting in high operating costs for such stores. For customizable products that also provide a tactile experience, such as mattresses, it would be desirable to have one device or system that can mimic and simulate the tactile experience of many different products. In this way, by adjusting settings on the one device or system that can mimic many products, consumers may choose their preferred product characteristics whilst using only the one device.

The current market for adjustable mattresses or customized, made-to-order mattresses is driven by consumers seeking personalized comfort and support. Traditional mattresses offer limited customization options, leading to discomfort for many users. As a result, there is a growing demand for mattresses that can be tailored to individual preferences, such as firmness level, support, and sleeping position. Some methods and devices are known to incorporate various mechanisms to customize or adjust the "feel" within a common mattress platform. For example, various mattresses systems are known that are "adjustable", typically feature adjustable air chambers, foam layers, or spring systems that can be customized and/or adjusted to suit the user's needs. And, customized, or customizable made-to-order mattresses take personalization a step further by allowing consumers to choose specific materials, firmness levels, and other features to meet their unique needs and preferences. These mattresses are often more expensive than traditional mattresses but offer a higher level of comfort and satisfaction.

However, existing adjustable bed systems that allow for customization of firmness settings are designed as end-products for consumer use, rather than also as tools to simulate the feel of a separately manufactured non-adjustable personalized mattress. Consequently, there is a need for a system that can accurately simulate the experience of a customized mattress with specific foam and spring configurations, allowing consumers to test and optimize their preferred settings before ordering a made-to-order non-adjustable mattress. Such a system would bridge the gap between the immediate tactile feedback of traditional retail shopping and the streamlined logistics of online mattress sales.

SUMMARY OF THE INVENTION

The present invention relates to enabling tactile impressions of made-to-order or personalized products, such as customized mattresses, cushions, or other furniture, and a method and system that enables a tactile impression to be determined when shopping for the personalized product including a variety of elements with adjustable firmness arranged in ergonomic contoured configuration areas.

It is thus an object of the present invention to provide adjustable bedding or seating systems utilizing hybrid elements comprising outer walls made of resilient materials, such as foam, stretched fabrics, metal coil springs or the like, defining hollow interior cavities, with inflatable bladders disposed within the hollow interior cavities for adjusting the bed comfort and characteristics to fit a specific user, i.e., customizable to the individual(s).

It is a feature of the present invention to utilize hybrid elements consisting of outer walls encasing inflatable bladders that, when pressurized, allow for individual adjustment of firmness and the simulation of different material configurations. The outer walls may comprise at least one resilient material, such as foam, soft or stretchable material, fiber, metal coil springs, pocket springs or other objects or materials that have spring-like properties, or any combination of such elements.

The present invention relates to an adjustable system with hybrid elements and inflatable bladders, capable of simulating different compression stress-strain characteristics for a customizable experience. An array of hybrid elements is arranged and interconnected, with each element having an outer wall encasing an inflatable bladder. Increasing fluid pressure or fluid quantity of each bladder changes the firmness of the hybrid element. Upper and lower plates May be mounted above and below each hybrid element in order to isolate each hybrid element and allow each hybrid element to act independently with minimal change in shape upon change in fluid pressure or fluid quantity, so the firmness of each element can be individually adjusted to simulate different configurations.

Within the array, the hybrid elements may each act independently but are connected in lines and zones to provide a cohesive yet flexible support system. The adjustable mattress system can simulate different compression stress-strain characteristics to mimic various foam spring types and hardness levels. This allows the bed to serve as a customizable simulator to determine a user's preferred mattress characteristics.

According to one aspect of the present invention, such an adjustable mattress system may be used in the form of a demonstration or test bed, seat, or cushion, which provides an adjustable simulator for consumers to test. In such a use, a user may obtain an initial specification based on a predetermined comfort profile, developed through interactive online interrogation, previous use, based on specifications of existing products, or elsewhere. The test system may thereby have the settings "adjusted" to this initial profile, enabling the consumer to have tactile interaction with such a simulated configuration. Further, adjustments to the initial setting may also be made to provide a final configuration in which the characteristics can then be measured, identified and codified to use to manufacture a customized, user-specific product, of a fixed construction (i.e., non-adjustable). Such use of a "test system" can facilitate online sales, in addition to those through brick-and-mortar stores, through the manufacturing of user customized products.

According to another aspect of the present invention, such capabilities enable a business model where the adjustable "test mattress" or seat cushion is placed in various partner locations as testing stations. Large retail stores are no longer required to house multiple mattresses or cushions of different configurations. Wherever the final customized configuration is determined, it may be transmitted electronically to the factory for production of non-adjustable mattresses.

In some situations, the adjustable system may also be used as a standalone commercial product for individual use. In such an application, the firmness of the mattress, seat, cushion, pillow or other upholstered furniture piece can be manually adjusted by the user during use to suit their preferences. Alternatively, the system may incorporate sensors to monitor the user's body position and automatically adjust the firmness of different zones using algorithms, such as a neural network, to optimize comfort and support in real-time.

It is an advantage of the present invention to provide an adjustable bedding or seating system that can simulate different compression stress-strain characteristics, allowing for a customizable and user-specific sleeping experience.

It is another advantage of the present invention to offer an adjustable simulation mattress that can be used to subsequently create a customized, non-adjustable mattress based on the user's preferences.

It is another advantage of the present invention to provide a system that allows for individual adjustment of firmness, addressing the need for customizable comfort levels in adjustable mattress systems or adjustable seating systems.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
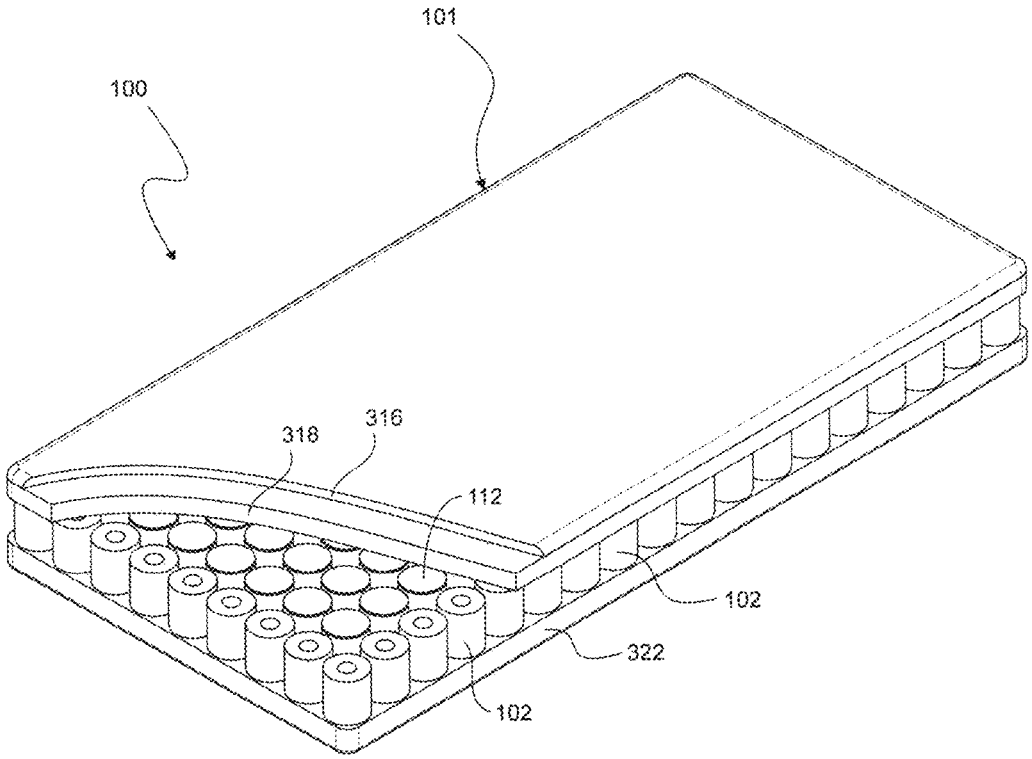
FIG. 1 is a perspective, partial cutaway view of an adjustable mattress system with hybrid elements and inflatable bladders according to the preferred embodiment of the present invention.
Figure 2:
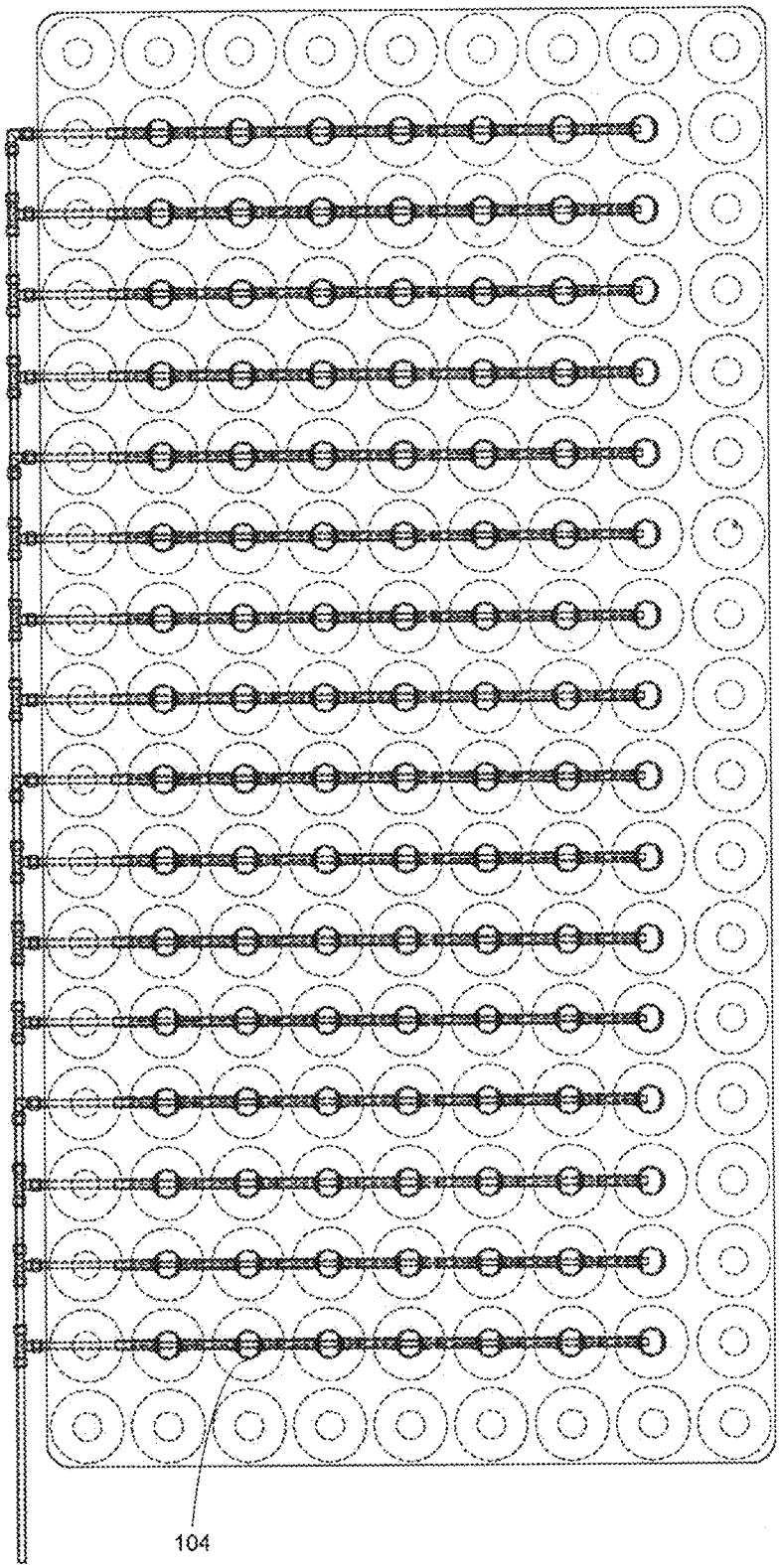
FIG. 2 is a top pan view thereof illustrating the construction of a hybrid element with an inflatable bladder within its hollow core.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the FIGS.

Referring now to the drawings, wherein like reference numerals indicate the same parts throughout the several views, an adjustable mattress system, generally noted as 100, is shown according to a preferred embodiment of the present invention. The adjustable mattress system 100 generally comprises an adjustable simulation mattress 101 having a hybrid support layer 102 with adjustable firmness or, more specifically adjustable compression stress-strain characteristics. The hybrid support layer 102 includes a group of hybrid elements 104 disposed therein.

Each hybrid element 104 comprises outer walls 106 made of resilient material with spring-like mechanical properties defining a hollow interior cavity 108. Within the hollow interior cavity 108 is disposed an inflatable bladder 110. In a preferred embodiment, the inflatable bladder 110 is made of non-stretchable material to maintain minimal change in shape upon change in fluid pressure or fluid quantity in the inflatable bladder 110. In an alternate embodiment, the inflatable bladder 110 is made of stretchable material. In at least one embodiment, the hybrid element 104 may also include an upper plate 112 and a lower plate 114 that connect the hybrid element 104 to mattress layers above and below the hybrid support layer 102.

In an alternative embodiment, jacket may be mounted around the outer walls 106 of the hybrid element 104 so that each jacket horizontally surrounds one of the hybrid elements 104. The jackets may be formed of a non-stretchable yet flexible material, such as a non-stretch fabric, foil or similar material. The jacket prevents the hybrid element 104 from expanding horizontally and vertically when fluid pressure or fluid quantity is increased in the inflatable bladders 110.

The firmness of each individual hybrid element 104, and thus the overall firmness of the adjustable mattress system 100, is adjusted by changing fluid pressure and/or fluid quantity within the inflatable bladders 110. Increasing fluid pressure and/or fluid quantity of the inflatable bladders 110 adds an additional force between the upper and lower plates 112, 114 of the hybrid elements 104, with the total force being the sum of the foam spring force and the inflatable bladder force, which changes with fluid pressure/quantity. The volume of fluid in the system and the shape of the inflatable bladders 110 also influence the shape of the curve of the compression stress-strain characteristics. The upper and lower plates 112, 114 distribute the force caused by the pressure of the inflated bladder 110 over a wider area, achieving a homogenous pressure-force distribution and preventing the feel of a pointy bladder when the mattress is compressed.

For purposes of the present invention the term "firmness" or "compression stress-strain characteristics" should be broadly interpreted as it relates to flexible cellular polymeric materials. By way of example, and not meant as a limitation, International Standard ISO 3386-2, specifies a method for determination of the compression stress-strain characteristics of flexible polymeric materials and may be a sufficient way of measuring the load-bearing properties of the adjustable mattress described herein.

The upper and lower plates 112,114 may be circular, oval, star-shaped, triangular-shaped, square-shaped, or any other suitable form which achieves a homogenous pressure-force distribution. In one embodiment, the upper and lower plates 112, 114 are made of a material characterized by both flexible and resilient properties. In another embodiment, hybrid elements 104 do not contain the upper and lower plates 112, 114, and their function of homogeneous transfer of pressure is replaced by using firmer materials in the mattress upper layers.

Figure 3:
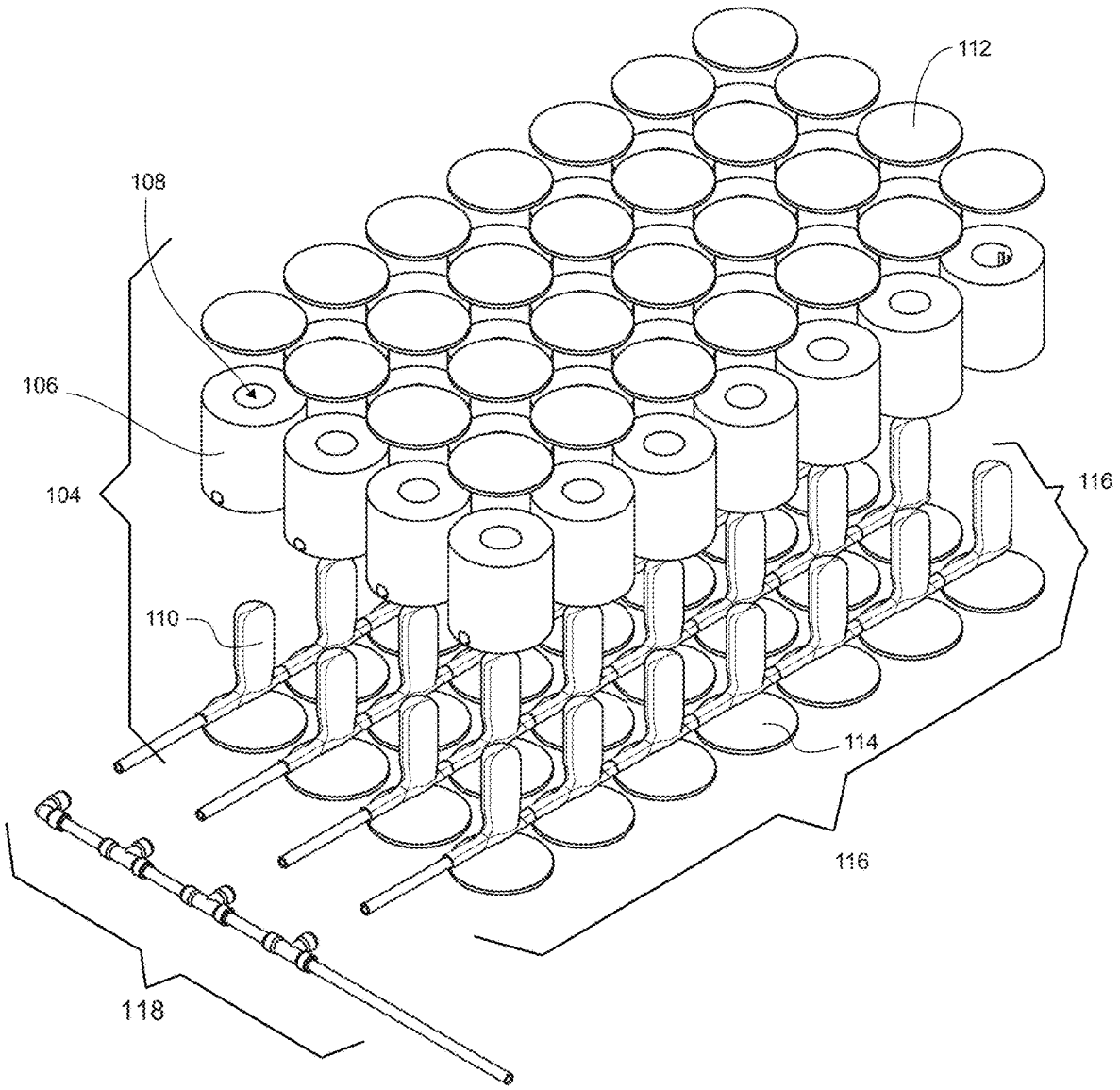
FIG. 3 is a partial exploded perspective view of an arrangement of hybrid elements in lines and zones for a cohesive yet flexible support system.

The hybrid elements 104 are arranged in lines 116 and zones 118 to provide a flexible yet cohesive support structure. A line 116 consists of a series of inflatable bladders 110 connected in series, welded to the same tube. The same tube connects a plurality of inflatable bladders 110 to a pressure source and keeps the inflatable bladders 110 at a fixed position. Fluids, such as air, other gas mixtures, water or any other fluids, may be provided to the plurality of inflatable bladders 110 via various holes in the same tube. It is understood that multiple tubes and/or pressure sources may be used. A zone 118 comprises one or more connected lines 116 together regulated by the same pressure source. This arrangement allows the firmness to be customized across different areas of the mattress to suit individual user preferences and requirements. FIG. 3 illustrates a single zone 118, while at least one implementation of the system has four zones 118, each with independently regulated pressure. However, the number of zones 118 and their configuration may vary in different implementations.

By adjusting the fluid pressure in various inflatable bladders 110, managing the total volume for fluid movement among interconnected bladders, tubes, and fluid tanks, and utilizing bladders of different shapes, the adjustable simulation mattress 101 can accurately replicate the compression stress-strain characteristics of diverse foam types, as well as different spring materials and constructions.

It is anticipated that the adjustable mattress system 100 may function as a demo bed, test bed, seat, cushion or simulation device. In this capacity, it can be used to demonstrate the features and customization options of the system to potential customers, allowing them to test and experience different firmness settings and configurations. As a simulation device, it enables users to fine-tune their preferred setup, which can then be translated into a personalized, non-adjustable product for production. This interchangeable use as a demonstration, testing, and simulation platform is a key feature of the adjustable mattress system 100. A user interacts with the system and the firmness of the various zones 118 are adjusted via the inflatable bladders 110 until an optimal configuration is reached. This configuration is then read out and transmitted electronically to a manufacturing facility that may then construct a personalized fixed-configuration product matching the user's tested and approved specifications.

Figure 5A:
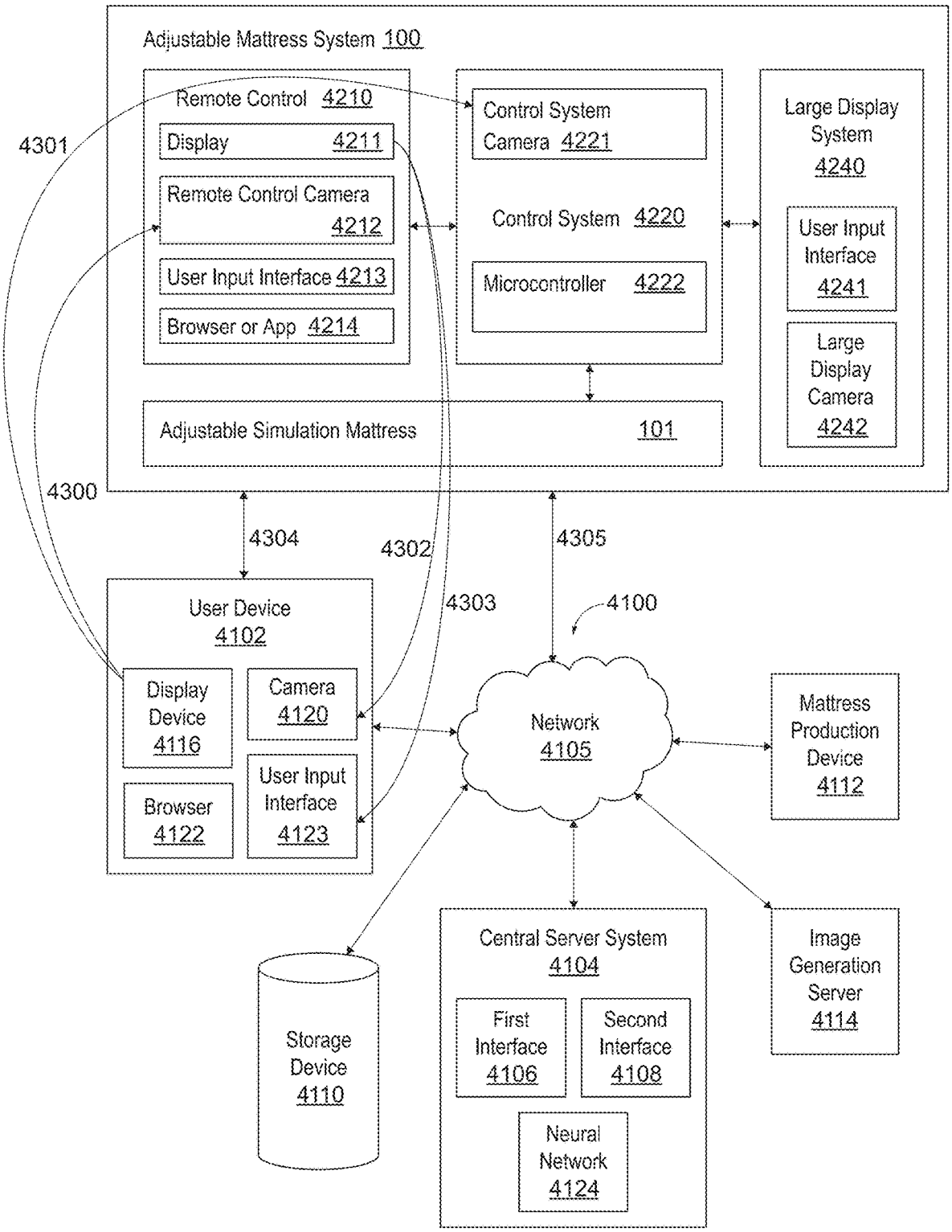
FIG. 5A illustrates an example system architecture for a customized mattress production system in accordance with an implementation of the present disclosure.

In another embodiment as shown in conjunction with FIG. 5A, the adjustable mattress system 100 allows users to physically experience and adjust the firmness settings of the mattress. The adjustable mattress system 100 comprises a Remote Control 4210, a Control System 4220, an Adjustable Simulation Mattress 4230, and a Large Display System 4240. The Remote Control 4210 includes a camera 4312 and a user input interface 4213. The Control System 4220 may be located under the Adjustable Simulation Mattress 4230 and may include a camera 4221, a Microcontroller 4222, pressure sensors, fluid tanks, at least one power source, at least one pressure and/or fluid source and all other electro-mechanical parts needed to control fluid pressure and/or fluid quantity within the inflatable bladders. The Control System 4220 is used for independently adjusting fluid pressure and/or fluid quantity in the inflatable bladder 110 in each hybrid element 104, thereby adjusting the firmness of each hybrid element 104. The Microcontroller 4222 is configured to control all parts of the Adjustable Mattress System 100. The Large Display System 4240 includes a user input interface 4241 and a camera 4242.

The adjustable mattress system 100 may connect to the existing system in several ways. In one embodiment 4300, the camera 4312 on the Remote Control 4210 may be used to scan a QR code displayed on the user device 4102 to transmit calculated firmness settings from the user's personal device to the Remote Control, which then controls the Adjustable Simulation Mattress 4230. Alternatively, 4301, the camera 4221 located on the Control System 4220 can be used to scan the QR code. When a user finds their preferred firmness setting combination on the adjustable mattress system 100, a number and a QR code for this new setting will be displayed on the Display 4211 (4302), which the user can scan with their device 4102 to complete the purchase of the mattress with their desired firmness. The user may also input the number code via the user input interface 4123 on their phone or computer (4303). Other means of transmitting information, such as wireless, optical, or electrical, can be used (4304, 4305), with codes like QR, EAN, or other visual information transmitting means.

The Large Display System 4240 is a TV or computer monitor that attractively and intuitively displays the current firmness settings of the adjustable mattress system 100. It includes a user input interface 4241 and a camera 4242 capable of reading codes, allowing it to function similarly to the Remote Control 4210.

The adjustable mattress system 100 provides users with a physical experience of the mattress firmness settings and allows them to easily adjust firmness zones 118 and purchase their desired configuration. The various communication pathways between the adjustable mattress system 100, the user device 4102, and the central server system 4104 enable a seamless integration of the physical testing process with the online ordering and customization system.

Figure 5B:
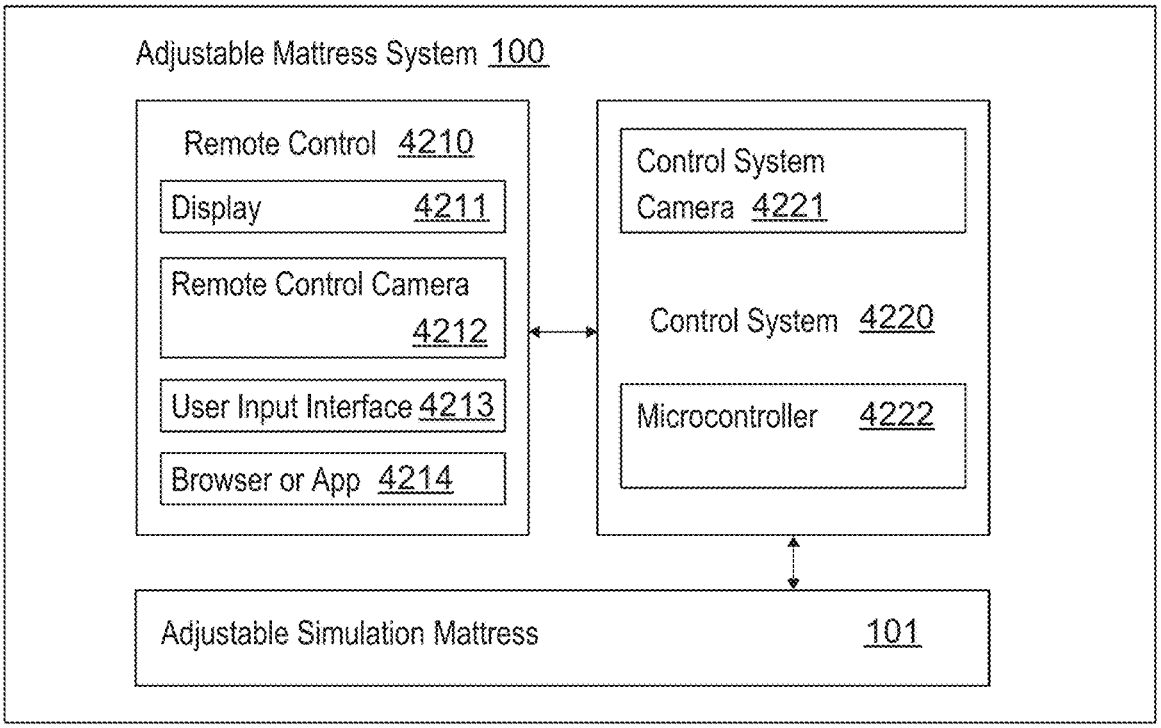
FIG. 5B illustrates an example system architecture for a customized mattress production system in accordance with an implementation of the present disclosure.

In another embodiment as shown in conjunction with FIG. 5B, the system includes an Adjustable Mattress System 100 that allows users to physically experience and adjust the firmness settings of the mattress and May output final approved firmness configuration.

The Adjustable Mattress System 100 comprises a Remote Control 4210, a Control System 4220, and an Adjustable Simulation Mattress 101. The Remote Control 4210 may include a Remote Control Camera 4212 and a user input interface 4213. In some implementations, Remote Control 4210 may be at least one knob, or at least one slider, at least one microphone or any other interactive part capable of transmitting user input values to the Control System 4220. The Control System 4220 may be located under the Adjustable Simulation Mattress 101 and may include a Control System Camera 4221, a Microcontroller 4222, zero or more pressure sensors, at least one power source, at least one pressure and/or fluid source and all other electro-mechanical parts needed to control fluid pressure and/or fluid quantity within the inflatable bladders. The Control System 4220 is used for independently adjusting fluid pressure and/or fluid quantity in the inflatable bladder in each hybrid element 104, thereby adjusting the firmness of each hybrid element 104. The Microcontroller 4222 is configured to control all parts of the Adjustable Mattress System 100. The Microcontroller 4222 may be configured to output final approved firmness configuration, and/or to transmit the data model to a mattress production manufacturing system for production of a non-adjustable mattress matching the customized firmness. In some implementations, the Microcontroller 4222 may transmit the final approved firmness configuration to the user via data link, visual or audio representation, or any other part capable of transmitting output values to the user.

The adjustable system may also be used as a standalone commercial product for individual use. In such an application, the firmness of the mattress, seat, or cushion can be manually adjusted by the user during use to suit their preferences. In such an application, it is also possible to set the adjustable system to firmness presets that mimic specific product firmness characteristics, or user's defined presents. Alternatively, the system May incorporate sensors to monitor the user's body position and automatically adjust the firmness of different zones using artificial intelligence or other types of algorithms to optimize comfort and support in real-time.

A key aspect of the present invention is the concept of changing the firmness and softness of the material and the overall product, whether it be a mattress, seat, sofa cushion, or any other type of furniture or bedding. This adjustability allows the system to accurately simulate the feel of a wide variety of materials and configurations, making it a valuable tool for both product demonstration and customized manufacturing.

Aspects and implementations of the disclosure are directed towards a customized mattress. Specifically, the customized mattress is provided to a user by a system that anticipates the user's tactile experience. The user may be provided with customization options for the customized mattress. In response to receiving the customization options, an optimized customized mattress is provided to the user. The optimized customized mattress is generated based on a customized mapping of foam springs in view of the user's input. Additionally, the system may instead predict a mapping to better suit the user's needs and the mapping may instead be provided to the user.

Referring best in conjunction with FIG. 5A through FIG. 16, an overall system for and method of providing an adjustable mattress system adjusted to the mattress comfort and characteristics of a specific user or users. By way of example, and not meant as a limitation, a system architecture 4100, May include a user device 4102, a network 4105, a central server system 4104, a storage device 4110, a mattress production device 4112, and an image generation server 4114. System architecture 4100 unifies a pathway for transfers of data and/or instructions between the devices included therein. Through a series of transfers of data and/or instructions between devices, system architecture 4100 may carry out one or more functions.

Devices included in system architecture 4100 may transfer data and/or instructions to other devices included in system architecture 4100 or to devices external thereto through network 4105. For example, user device 4102, May transfer data to central server system 4104 through network 4105. In one implementation, network 4105 may include a public network (e.g., the Internet), a private network (e.g., a local area network (LAN) or wide area network (WAN)), a wired network (e.g., Ethernet network), a wireless network (e.g., an 802.11 network or a Wi-Fi network), a cellular network (e.g., a Long Term Evolution (LTE) network), routers, hubs, switches, server computers, and/or a combination thereof.

In one implementation, storage device 4110 may be a memory (e.g., random access memory), a cache, a drive (e.g., a hard drive), a flash drive, a database system, or another type of component or device capable of storing data. Storage device 4110 may also include multiple storage components (e.g., multiple drives or multiple databases) that may also span multiple computing devices (e.g., multiple server computers). Storage device 4110 may store multiple mappings of mattresses. The mappings of mattresses stored within storage device 4110 may include one or more predefined mappings of foam springs and/or one or more derivations created by the online store of one or more of initial predefined spring mappings. The spring mappings within storage device 4110 may be arranged in ergonomic contoured configuration areas. A contoured configuration area may include one or a cluster of the same foam spring types.

User device 4102 may include computing devices such as personal computers (PCs), laptops, mobile phones, smart phones, tablet computers, netbook computers etc. User device 4102 includes a display device 4116, a camera 4120, and a browser 4122.

Central server system 4104 includes a first interface 4106, a second interface 4108, and a neural network 4124. Although first interface 4106, second interface 4108, and neural network 4124 are depicted as being internal to central server system 4104, in other implementations, one or more of these May be external to central server system 4104 and may be remotely accessible by central server system 4104. Details regarding neural network 4124 are described herein with respect to FIG. 11 through FIG. 13.

In an implementation, interactions between user device 4102 and central server system 4104 and/or image generation server 4114 may be through browser 4122. Additionally, the first interface 4106 and/or the second interface 4108 may interact with user device 4102 through browser 4122. For example, an app or web-based application may run within browser 4122 to allow a consumer employing user device 4102 to order a customized mattress created by an online store. User device 4102 may not have to install an app and may access the online store to create the customized mattress website through browser 4122. In other implementations, user device 4102 may download an app to order the customized mattress. Browser 4122 or an app may allow a consumer to enter input data utilized by the online store to anticipate the consumer's tactile experience when creating a customized mattress, regardless of whether a browser program running on browser 4122 is a stand-alone program or an embedded program, such as a browser program included as part of an operating system, or an installed app.

Although a single user device 4102 is depicted, in other implementations, two or more user devices may be used. In general, functions described in one implementation as being performed by user device 4102 can also be performed on other user devices in other implementations if appropriate. In addition, the functionality attributed to a particular component can be performed by different or multiple components operating together.

Central server system 4104 includes a first interface 4106 and a second interface 4108. Central server system 4104 may be one or more servers and/or computing devices (such as a rackmount server, a router computer, a server computer, a personal computer, a mainframe computer, a laptop computer, a tablet computer, a desktop computer, etc.), data stores (e.g., hard disks, memories, databases), networks, software components, and/or hardware components that may be used produce a customized mattress. For example, central server system 4104 may allow the online store to anticipate the consumer's tactile experience when creating a customized mattress for the consumer and output a mapping of the best mattress to mattress production device 4112.

Although central server system 4104 is depicted as including first interface 4106 and second interface 4108, in other implementations, any number of interfaces or no interfaces at all may be used. First interface 4106 and/or second interface 4108 may be an application programming interface (API). An API defines interactions between software application(s) and/or mixed hardware-software intermediaries. An API may gather data and/or communicate unidirectionally or bidirectionally with other applications.

First interface 4106 and second interface 4108 may communicate with each other and with user device 4102, image generation server 4114 and/or any other applications and/or devices. In an implementation, first interface 4106, May communicate with user device 4102 and may transmit and/or receive data from user device 4102. Second interface 4108 may communicate with image generation server 4114 and/or user device 4102 and may transmit and/or receive data from image generation server 4114 and/or user device 4102, respectively.

A consumer employing user device 4102 who wishes to purchase a mattress customized for his/her comfort by the online store may visit a website and/or an app. In order to anticipate the consumer's tactile experience, central server system 4104 may provide questions to the consumer via user device 4102. The consumer may view, via display device 4116, multiple customization options for the mattress provided by first interface 4106 of central server system 4104. The consumer may view the multiple customization options on a webpage of a browser, an app, etc.

The consumer may provide input data via user device 4102 in response to the multiple customization options to the second interface 4108 of central server system 4104. In addition, the consumer may provide generalized consumer proportion dimension data based on the consumer's dimensions to the second interface 4108 of central server system 4104 via user device 4102 and/or via image generation server 4114. The generalized consumer proportion dimension data may include one or more of the following: a distance between hips and shoulders of the consumer, a height of the consumer, weight of the consumer, a shoulder width, a hip circumference, etc. Other distances/measurements may also be included. The generalized consumer proportion dimension data may be determined by image generation server 4114 based on photograph(s) obtained by image generation server 4114 and/or based on information provided by the consumer via user device 4102.

In implementations of the disclosure, a "consumer" or a "user" may be represented as a single individual. However, other implementations of the disclosure encompass a "consumer" or a "user" being an entity controlled by a set of consumers and/or an automated source.

Image generation server 4114 may be and/or include one or more computing devices (e.g., servers), storage devices, networks, software components, and/or hardware components that may be used to allow consumers to provide photographs or other media using one or more mobile devices (e.g., phones, tablet computers, laptop computers, wearable computing devices, etc.) and/or any other suitable devices. For example, image generation server 4114 may communicate with user device 4102 via network 4105 using telephony communication, Multimedia Message Service (MMS) messaging, or another app to obtain or otherwise scan a photograph. Image generation server 4114 May allow a consumer employing user device 4102 to upload or otherwise capture a live photograph using the camera of user device 4102.

In situations in which the systems discussed here collect personal information about consumers, or may make use of personal information, the consumers may be provided with an opportunity to control central server system 4104 and/or image generation server 4114 collects consumer information. In addition, certain data may be treated in one or more ways before it is stored or used, so that personally identifiable information is removed. For example, a consumer's identity and/or photograph may be treated so that no personally identifiable information can be determined for the consumer, or a consumer's geographic location may be generalized where location information is obtained (such as to a city, ZIP code, or state level), so that a particular location of a consumer cannot be determined. Thus, the consumer may have control over how information is collected about the consumer and used by image generation server 4114, central server system 4104, and/or any other component of the system architecture 4100.

In an implementation, image generation server 4114 may assign an identification (ID) to a consumer employing user device 4102. Upon capturing or otherwise obtaining photograph(s) of the consumer and calculating relevant information from the photograph, image generation server 4114 may associate the ID of the consumer with the information and discard the photograph. Therefore, image generation server 4114 may not store the photograph and expunge the photograph upon calculating the relevant information and thus, the photograph is destroyed and cannot be distributed.

Based on input data provided by the consumer, including generalized consumer proportional dimension data which may be provided by the consumer and/or by image generation server 4114 (which obtains the generalized consumer proportional dimension data from photograph(s)), central server system 4104 may obtain a mapping of the customized mattress from storage device 4110. A consumer employing user device 4102 may view the mapping on display device 4116 and select to order the customized mattress based on the mapping. The order for the customized mattress is provided by central server system 4104 to mattress production device 4112 via network 4105. Details regarding the generalized consumer proportional data and how it is obtained are described herein below with respect to FIG. 50B.

The mapping includes various layers of the mattress. The mapping of one (or more) layer(s) of the mattress include(s) various types of foam springs placed in corresponding ones of multiple ergonomic contoured configuration areas. Each type of foam spring may have a unique corresponding strength/firmness and/or density rating. While firmness may be quantified using various measurements, such as indentation force deflections, it may also be qualified by subjective sensory assessment or descriptive terms based on user experience. Examples of qualified firmness include super soft, soft, medium, hard, super hard, etc. Density ratings refer to mass per unit volume and may be ranked numerically (from most dense to least dense or vice versa) or in other ways.

Mattress production device 4112 may then produce the customized mattress.

For purposes of clarity by way of example, suppose now that a consumer named John wishes to order a customized mattress. John may employ user device 4102 to access an online store via a website and/or a mobile phone application (app) to view various customization options for the customized mattress. The customization options are sent by first interface 4106 of central server system 4104 to user device 4102 so that John can view them on display device 4116. Exemplary customization options are described in the FIGS. 6A6C below.

User device 4102 may capture John's responses to the customization options and the responses may be transferred from user device 4102 to second interface 4108 of central server system 4104 via network 4105. Such responses are referred to as input data. The input data may include one or more of the following: John's body weight measurement, a total number of consumers (including John) utilizing the mattress, a mattress size, John's sleep position, John's height measurement, a location of pain experienced by the John, John's age, and/or John's mattress firmness preference.

After John selects his options, John may be provided with a query to provide dimensional measurements relating to his body. Examples of these measurements include a distance between his hips and shoulders of the consumer, his height, his shoulder width, or his hip circumference. Such measurements are referred to as John's consumer proportional dimension data. The request for the generalized consumer proportional dimension data may be submitted by first interface 4106 of central server system 4104 to be displayed on display device 4116 of user device 4102.

In response to the request, John may input the generalized consumer proportional dimension data manually onto the website and/or app and second interface 4108 of central server system 4104 may receive the consumer proportional dimension data. In other implementations, the generalized consumer proportional dimension data may be provided to the central server system 4104 by first interface 4106 or by another interface or software program.

In an alternative implementation, John may wish to use a photo scanning app to determine his consumer proportional dimension data. John May access the photo scanning app which would instruct John to use camera 4120 to take one or more photographs. The photo scanning app may be controlled by image generation server 4114, central server system 4104, and/or another device(s), server(s), and/or system(s). The photo scanning app would receive the photograph(s) captured by camera 4120 and transmitted via user device 4102. The photo scanning app may assign an identification (ID) or code to the photograph(s) in order to associate the photograph(s) with John. In an implementation, the ID or code may be anonymous and/or securely transferred (e.g., using public key/private key infrastructure, etc.) so that John's personal information is not transferred. In an implementation, the photo scanning app May determine the dimensions of the consumer and only the dimensions may be transferred by the photo scanning app to the central server.

Once image generation server 4114 receives the photograph(s), image generation server 4114 scans the photograph (s) to determine the consumer proportional dimension data. Image generation server 4114 may use any of a variety of methods and/or algorithms in order to obtain the consumer proportional dimension data. Image generation server 4114 then transmits the generalized consumer proportional dimension data to second interface 4108 of central server system 4104 (and/or first interface 4106 and/or another device(s), server(s), and/or system(s)) via network 4105 and the photograph(s) are destroyed and not cached. The generalized consumer proportional dimension data may be transferred with the ID or code so central server system 4104 may properly associate the ID or code with John.

Central server system 4104 may then determine the optimal mattress for John based on the input data and the generalized consumer proportional dimension data. Central server system 4104 may create a mattress code such as a stock-keeping unit (SKU), a QR code, etc., that contains data which corresponds to the mattress providing John with an optimal tactile experience. Details regarding this code are described herein with respect to FIG. 7A.

Central server system 4104 may communicate with storage device 4110, via network 4105, in order to obtain a mapping of the mattress providing John the optimal tactile experience. Specifically, the second interface 4108 (and/or first interface 4106 and/or another device(s), server(s), and/or system(s)) may correspond with storage device 4110.

Storage device 4110 may store multiple foam spring configurations and/or multiple ergonomic contoured configuration areas (described in detail herein below) for mattresses. In one example, storage device 4110 may store one or more databases of mattress codes.

Second interface 4108 may communicate with the storage device 4110 to determine placement of types of foam springs.

In an implementation, John's mapping may include multiple layers. Details regarding mattress layers are described herein with respect to FIG. 7B. In one example, the first layer of the mattress in the mapping may be a layer of foam. The second layer may include ergonomic contoured configuration areas where each ergonomic contoured configuration area contains one (or more) types of foam springs. The mapping may also include a type of foam spring of an ergonomic contoured configuration area that is placed along a periphery of the second layer.

Once central server system 4104 obtains the mapping, first interface 4106 (and/or second interface 4108 and/or another device(s), server(s), and/or system(s)) of central server system 4104 may provide the mapping for display to John on display device 4116 of user device 4102. In an implementation, central server system 4104 may format the mapping to provide an aesthetically appealing graphic(s) to user device 4102. Should John wish to purchase the mattress in view of the mapping, John may do so by adding the mattress mapping to his shopping cart and checking out using any electronic transaction method.

However, should John wish to change any of the input data he provided in response to the customization options, John may go back to the customization options and modify his response(s). Central server system 4104, May obtain a modification to the mapping (or retrieve a new mapping from storage device 4110) in view of John's changes. The modifications may be to modify any one or more ergonomic contoured configuration areas including modifying the placement of the foam springs. John may then check out of his shopping cart containing the modification to the mapping.

Central server system 4104 may thereafter receive a confirmation of John's purchase upon a successful checkout. For example, a payment processing device may transmit a payment confirmation to central server system 4104. In response to receipt of the confirmation, the second interface transmits the mapping (or the modification to the mapping, if applicable) to mattress production device 4112. Mattress production device 4112 may use the mapping to build John's customized mattress.

Figure 6A:
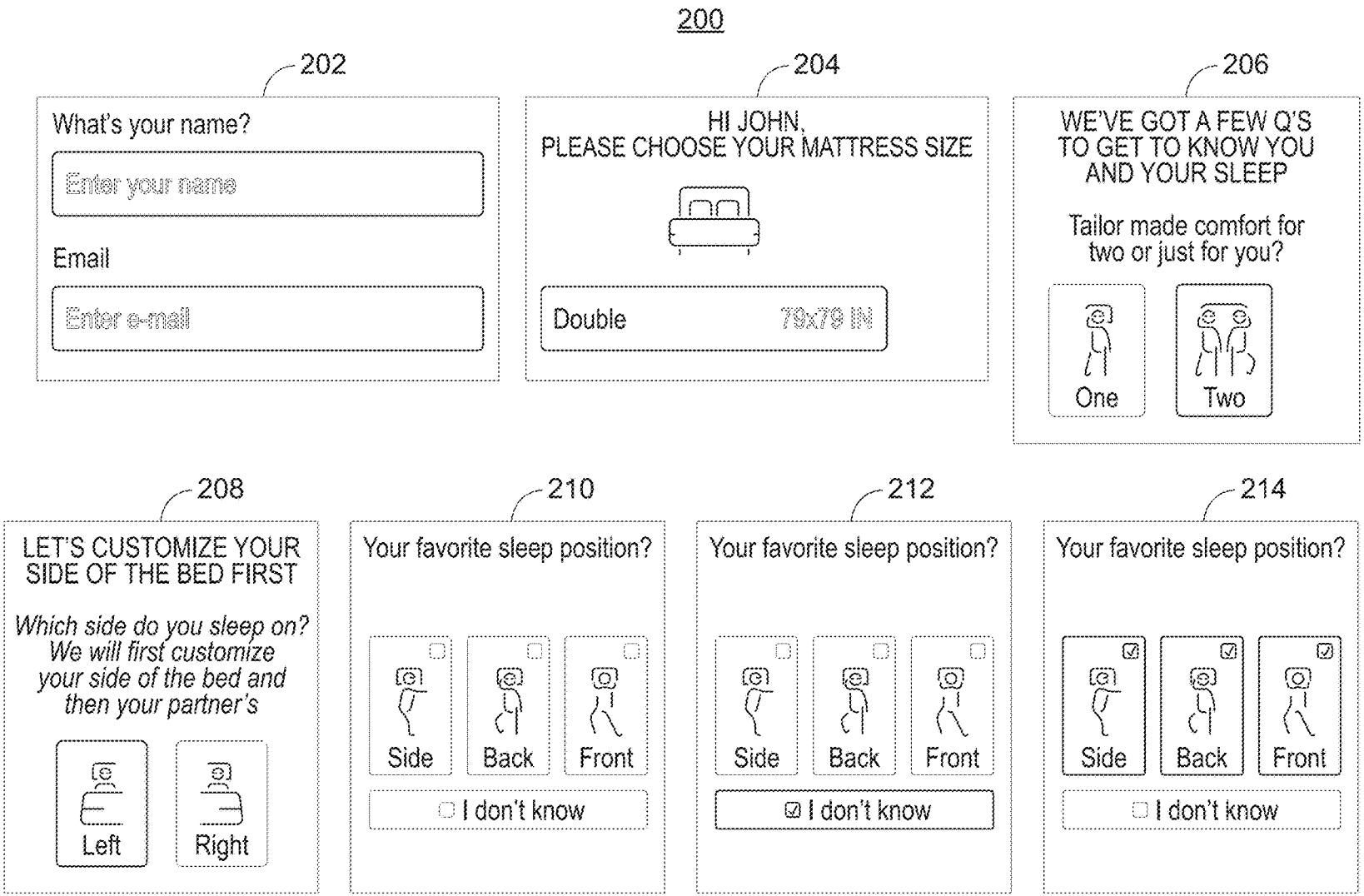
FIGS. 6A-6C illustrate exemplary options provided to a user device in accordance with an implementation of the present disclosure.
Figure 6B:
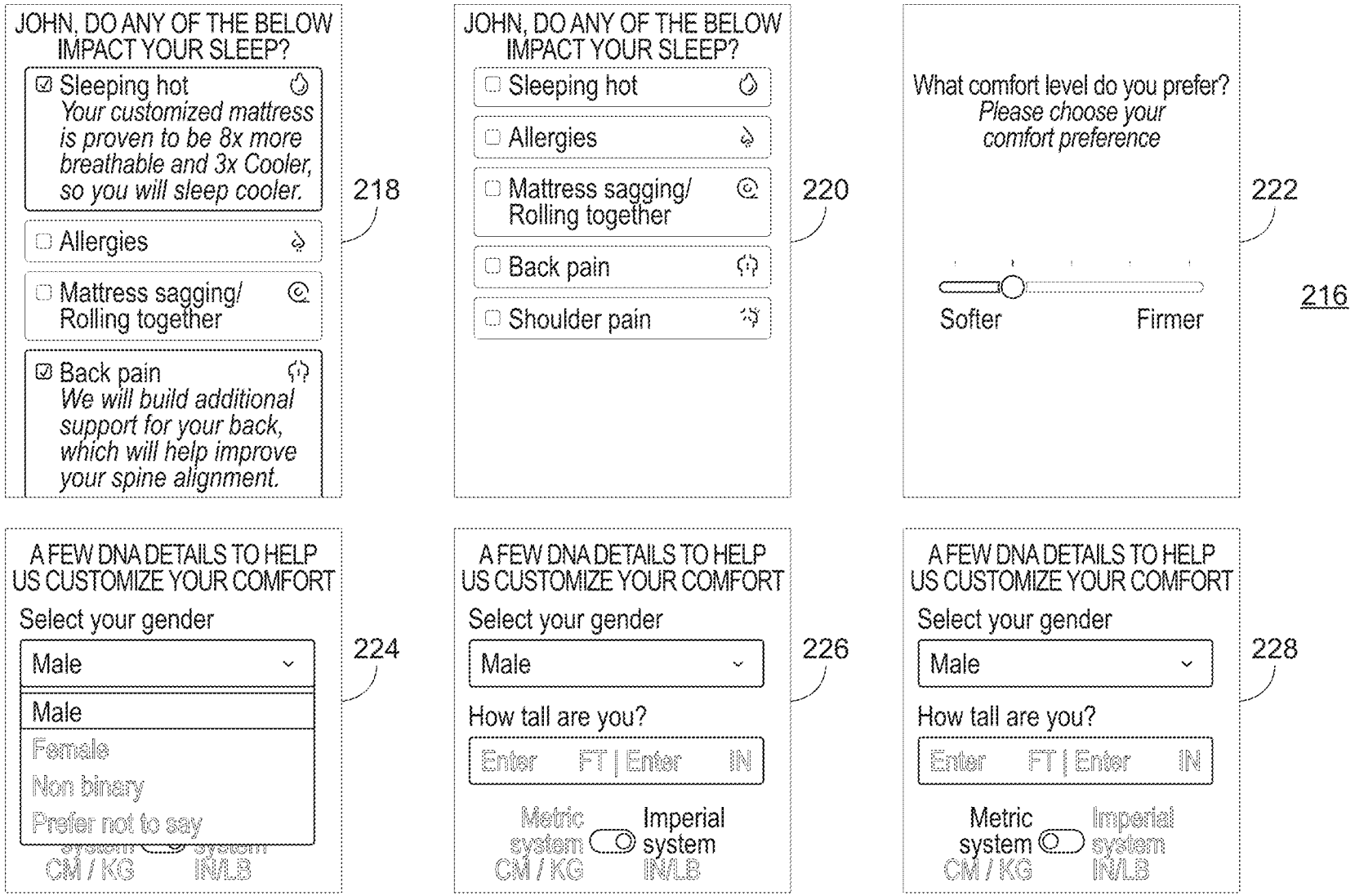
Figure 6C:
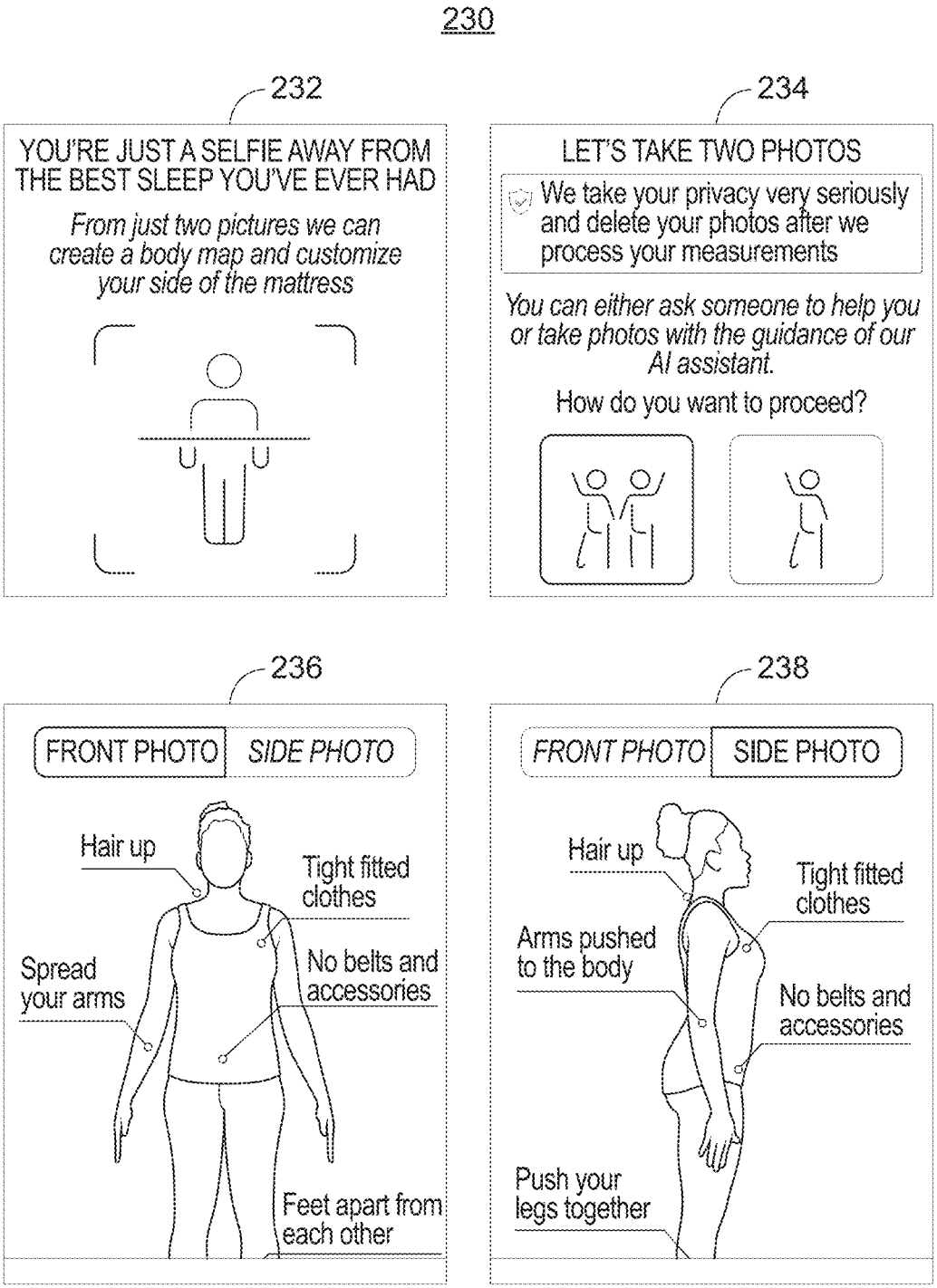

FIGS. 6A-6C illustrates exemplary user interfaces displaying options. FIG. 6A illustrates exemplary user interfaces 200. User interfaces 200 may be depicted on display device 4116 of user device 4102. User interfaces 200 may be generated by first interface 4106 (and/or second interface 4108 and/or another device(s), server(s), and/or system(s)) of central server system 4104 and transmitted to user device 4102 via network 4105.

An interface 202 requests a user to enter his/her name. An interface 110 requests that a user enter a mattress size. An interface 206 requests that a user provide a number of users that will utilize the mattress. An interface 208 requests information from the user regarding what side of the mattress he/she sleeps on. An interface 210 requests that a user provide his/her favorite sleep position. An interface 212 displays an input of "I don't know" received from a user employing user device 4102. An interface 214 displays an input provided by the user who selected "side", "back", and "front" in response to the question posed in interface 210.

Referring now to FIG. 6B, user interfaces 216 are depicted. An interface 218 requests that a user provide an impact of his/her sleep. An interface 220 further depicts additional impacts selectable by the user. An interface 222 requests that a user provide a comfort level preference. An interface 224 requests that a user provide his/her gender. An interface 226 requests that a user provide his/her height. An interface 228 depicts a selection from a user to toggle the measurement selection from the imperial system to the metric system.

Referring now to FIG. 6C, user interfaces 230 are depicted. An interface 232 requests that the user selects the option to take photo(s) via the photo scanning app. An interface 234 requests that a user select how he/she wishes to take the photograph(s) (e.g., by either asking someone to help the user take photos or use the artificial intelligence (AI) assistant. An interface 236 and an interface 238 provide guidance for taking pictures in a front view and a side view, respectively. Based on the photograph(s), image generation server 114 can generate generalized consumer proportional dimension data for the user.

In an alternative embodiment, the system features user interfaces designed to facilitate manual entry of generalized consumer proportional dimension data. One interface prompts the user to input their shoulder width. Another interface requests the user's hip circumference. A further interface asks for the distance from the user's shoulder to their hip. Additional measurements may be solicited to assist in crafting a highly customized mattress tailored to the user's needs Other interfaces may provide additional customization options to a user employing user device 4102.

Figure 7A:
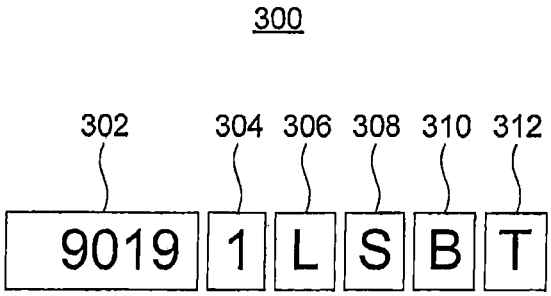
FIG. 7A illustrates an exemplary mattress code in accordance with an implementation of the present disclosure.

FIG. 7A illustrates an exemplary mattress code 300. In an implementation, mattress code 300 may be generated by central server system 4104 in response to receiving input data from user device 4102. The input data is responsive to customization options provided by central server system 4104. Exemplary customization options are shown in FIGS. 8A-8D. In other implementations, mattress code 300 may be generated by another device(s), server(s), interface(s) and/or system(s)).

Mattress code 300 includes a first segment 302, a second segment 304, a third segment 306, a fourth segment 308, a fifth segment 310, and a six segment. All the segments combine to create mattress code 300 corresponding to a customized user mattress. Fewer or greater segments than depicted may be used. One or more of the segments may be left blank and not contain any digits. Moreover, any combination of alphanumeric numbers, symbols, etc. may be contained in the segments.

First segment 302 contains the digits 9019. First segment 302 may be a code that corresponds to a user's selection of a mattress size. In the above example, John may wish to order a double-sized mattress. When John provides input data indicative of a double-sized mattress in response to the customization option requesting a mattress size, user device 4102 may transmit the input data to central server system 4104 via second interface 4108. Upon receiving the input data, central server system 4104 may encode the selection for a double-sized mattress as 9019.

In some implementations, a user may select a mattress size as single (e.g., twin), double (e.g., full), queen, king, super king, California king or another size. An input data selection of a double size mattress, a king size mattress, and super king size mattress may correspond to the following corresponded segmented digits, respectively: 13519, 15020, and 18020.

Second segment 304 contains the digit 1. Second segment 304 may be a code that corresponds to a user's selection of a number of users that will utilize the mattress. Referring again to the example above, John may wish to indicate that a single user will utilize the mattress. When John provides input data indicative of a single user in response to the customization option requesting a number of users, user device 4102 may transmit the input data to central server system 4104 via second interface 108. Upon receiving the input data, central server system 4104 may encode the selection for a single user as 1. Should the input data indicate that two users will utilize the mattress, second segment 304 may contain the digit 2.

Third segment 306 contains L. Third segment 306 may be a code that corresponds to a user's selection of a side of the mattress the user sleeps on. Referring again to the example above, John may wish to indicate that he prefers to sleep on the left side of the bed. When John provides input data indicative of a left side preference in response to the customization option requesting which side of the mattress John sleeps on, user device 4102 May transmit the input data to central server system 4104 via second interface 4108. Upon receiving the input data, central server system 4104 may encode the selection for the left side of the mattress as L. Should the input data indicate that the user selects that he/she sleeps on the right side of the bed, third segment 306 may contain the digit R.

Fourth segment 308 contains S. Fourth segment 308 may be a code that corresponds to a user's selection of a comfort level of a user in terms of a firmness scale of the mattress. Referring again to the example above, John may wish to indicate that his comfort level is the softest. When John provides input data indicative of a softest comfort level selection in response to the customization option requesting which comfort level John prefers, user device 4102 may transmit the input data to central server system 4104 via second interface 4108. Upon receiving the input data, central server system 4104 may encode the selection for the comfort level as S. A comfort indicator may be provided on an interface to the user using a sliding feature, as depicted in interface 222. Should the input data indicate that the user selects a medium comfort level, fourth segment 308 may contain M; and if the user selects a firmest comfort level, fourth segment 308 may contain F.

Fifth segment 310 contains B. Fifth segment 310 may be a code that corresponds to a user's selection of a sleep position. Referring again to the example above, John may wish to indicate that his sleep position is back. When John provides input data indicative of a back position in response to the customization option requesting which position John prefers, user device 4102, May transmit the input data to central server system 4104 via second interface 4108. Upon receiving the input data, central server system 4104 may encode the selection for the back position as B. Should the input data indicate that the user prefers a front position, back position, back and front, or the user selects the option "I don't know," fifth segment 310 may contain B; and if the user selects all the positions, side, side and back or side and front, fifth segment 310 may contain S.

Sixth segment 312 contains T. Sixth segment 312 may be a code that corresponds to a user's height. Referring again to the example above, John may wish to provide his height (and it may be determined that his height is tall, i.e., the distance between his shoulder and hips is above 60 cm and thus, his height exceeds a certain length, etc.). Otherwise, John may simply input the distance between his shoulder and hips or other measurement as input data. In an alternative implementation, information regarding height may be determined in view of generalized consumer proportional dimension data that is determined in view of photograph(s) of the user.

In an implementation, edges of a mattress may have a contoured configuration area that contains firmer springs to allow for users to sit on the edges of the mattress with support.

When John (or image generation server 4114 or central server system 4104) provides input data indicative of a tall height (i.e., the distance between the user's shoulder and hips being above 60 cm), user device 4102 and/or image generation server 4114 may transmit the input data to central server system 4104 via second interface 4108. Otherwise, central server system 4104 may determine that the user is tall. Upon receiving the input data, central server system 4104 may encode the selection for a tall height as T. Should the input data and/or the generalized consumer proportional dimension data indicate a short selection/determination (i.e., the distance between the user's shoulder and hips being below 60 cm), sixth segment 312 may contain S or sixth segment 312 may be left blank.

After mattress code 300 is generated, one or more associated mappings stored by storage device 4110 can be obtained by central server system 4104.

Figure 4:
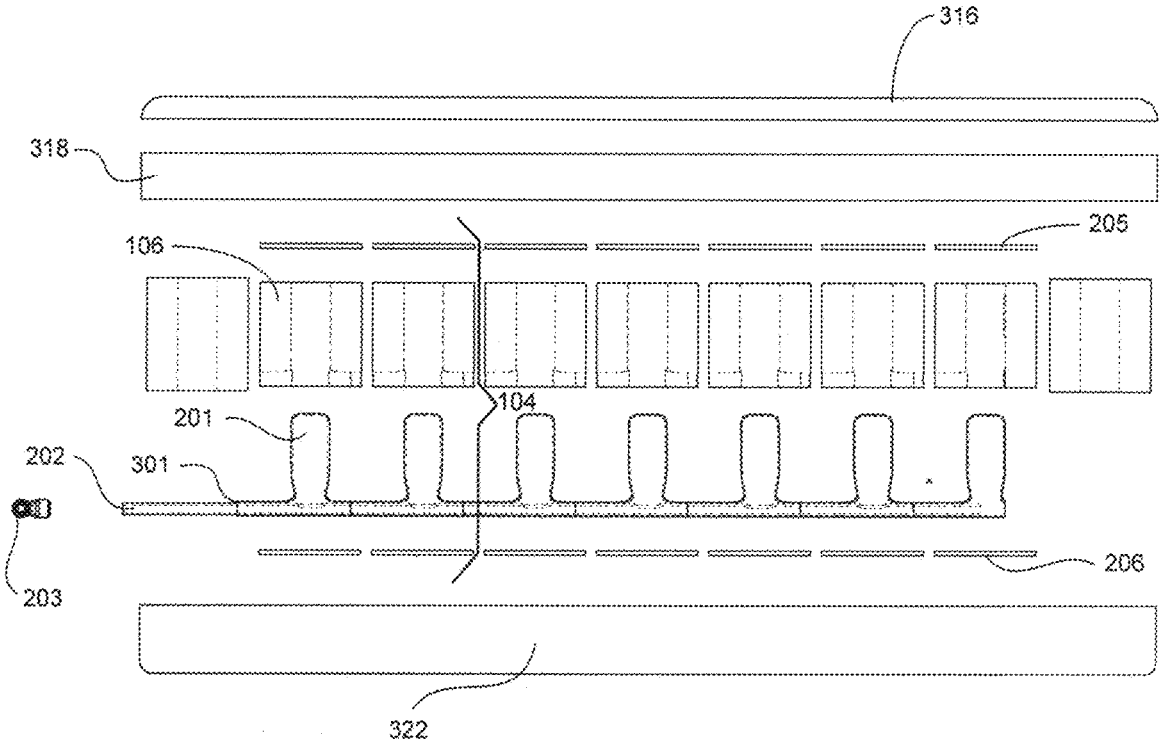
FIG. 4 is a side elevational view thereof.
Figure 7B:
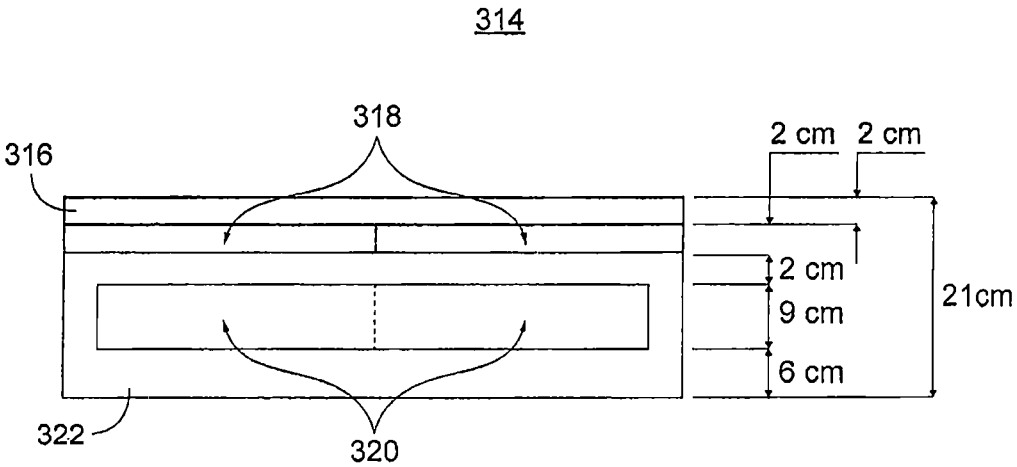
FIG. 7B illustrates an exemplary mattress layer architecture in accordance with an implementation of the present disclosure.

FIG. 4 and FIG. 7B illustrate an exemplary mattress layer architecture 314. Mattress layer architecture 314 contains four layers, however, fewer or greater layers than depicted may be used. The first layer 316 may be a memory foam layer. A second layer 318 may be a foam layer that can be customized by the online store based on anticipated user tactile experience. Second layer 318 may contain a soft memory foam, a soft medium memory foam, a medium super soft foam, a medium firm super soft foam, or a firm polyurethane foam. In the depicted implementation, second layer 318 contains two separate types of layers of foams (one for a user utilizing a left side of the mattress and another for a user utilizing a right side of the mattress). However, more or less types of foams than depicted may be used. Other types of foams of materials may be used.

A third layer 320 may be constructed based on the mapping of the customized user mattress. Exemplary mappings are described below with respect to FIGS. 8A-8D. Third layer 320 is completely encased by a fourth layer 322.

However, other arrangements may be used. Third layer 320 be constructed based on core options indicated by a corresponding mapping. For example, third layer 320 may be constructed for a user based on the following designations: short and soft, short and firm, tall and soft, or tall and firm. These designations each include a user's height (where short indicates that the distance between a user's shoulder and hips is below 60 cm and tall indicates that distance between a user's shoulder and hips is above 60 cm). Other designations and combinations may be used.

Although FIG. 7B depicts exemplary dimensions of the layers, other dimensions may be used. Mattress layer architecture 314 will vary based on the mattress size and the mapping of the customized mattress created by a user. Therefore, mattress layer architecture 314 may be stored by storage device 4110 in a database along with mappings. Additionally, mattress layer architecture 314 may be obtained by central server system 4104 and/or mattress production device 4112 in order to create a mattress.

Although foam layers and/or foam springs are described, in other implementations, other material of layers, metal springs, other springs, etc. May be used. One or more of the layers of the mattress may include sensors.

Figure 8A:
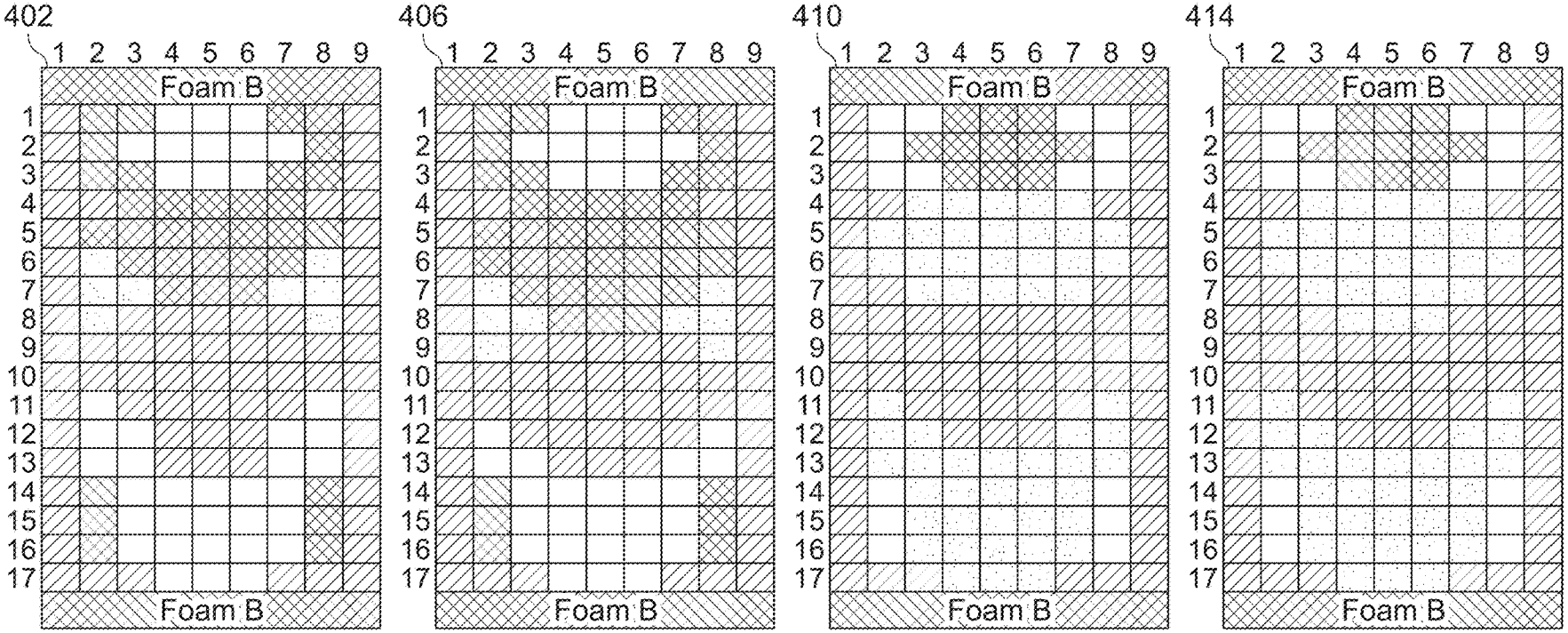
FIGS. 8A-8D illustrate exemplary mappings in accordance with implementations of the present disclosure.

FIGS. 8A-8D illustrates exemplary mappings. FIG. 8A illustrates single user mappings 400. Mappings 400 may be stored in storage device 4110 as depicted in FIG. 5A. Mappings include a layout of contoured configuration areas. Furthermore, each contoured configuration area may include one or more foam springs and/or one or more types of foam springs. For example, the following foam springs are depicted: foam A, foam B, foam C, foam D, foam E, and foam F. However, more or less types of foam springs may be used. In an implementation, the types of foams arranged from greatest strength and density rating (or firmness) to lowest corresponding strength and density rating are as follows: foam E, foam D, foam C, foam A, foam B. In other words, a foam having a greater strength and density rating would be firmer than one having a lesser strength and density rating.

A mapping 402 may correspond to a designation of short and soft. A table 404 provides a key for mapping 402. For example, row 1 of mapping 402 includes 17 foam D springs and 17 foam E springs.

A mapping 406 may correspond to a designation of tall and soft. A table 408 provides a key of mapping 406.

A mapping 410 may correspond to a designation of short and firm. A table 412 provides a key for mapping 410.

A mapping 414 may correspond to a designation of tall and firm. A table 416 provides a key of mapping 414. Other combinations of mappings and/or charts than depicted may be used. Furthermore, other designations than depicted may be used. Additionally, tables 404, 408, 412, and/or 416 may be stored in storage device 4110 along with mapping 402, mapping 406, mapping 410, and/or mapping 414, respectively, and may be obtained by central server system 4104 and/or mattress production device 4112 in order to create a mattress. Mappings, tables, and/or mattress layer architectures may be stored within database(s) of storage device 4110 or elsewhere and may be accessible by central server system 4104 and/or mattress production device 4112.

Figure 8B:
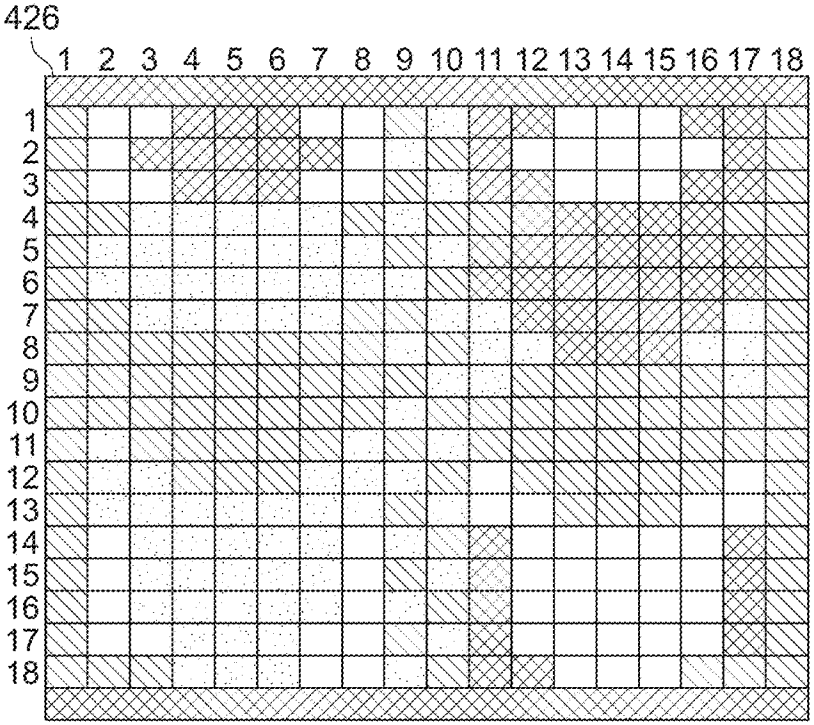
Figure 8B:
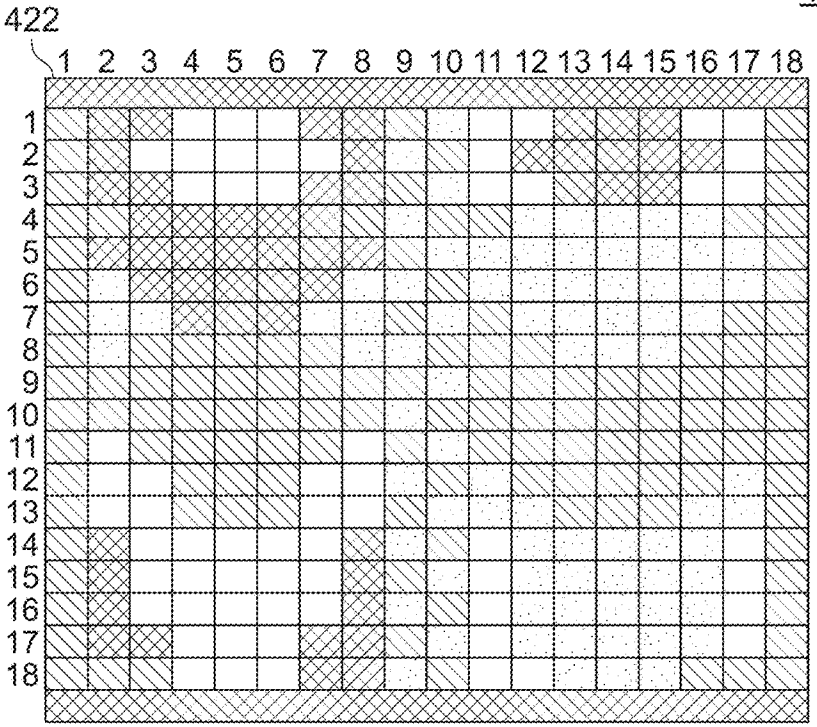

FIG. 8B illustrates double (or two) user mappings 420. Mappings 420 may be stored in storage device 4110 as depicted in FIG. 5A. A mapping 422 includes a layout of contoured configuration areas. Mapping 422 May correspond to a designation of short and soft on the left side and tall and firm on the right side. A table 424 provides a key for mapping 422. For example, row 1 of mapping 422 includes 18 foam D springs and 18 foam F springs.

A mapping 426 may correspond to a designation of short and firm on the left side and tall and soft on the right side. A table 428 provides a key of mapping 426.

In an implementation, suppose that a user selects a firmness/comfort preference as firm, and therefore, the difference in hardness of the springs between the shoulder and hip area may be about 1 kPa. Thus, additional foam springs acting as a bridge may not be needed between contoured configuration areas. Should a user select a firmness/comfort preference as soft, additional foam springs may be placed to act as a bridge between softer and firmer springs. The bridge of foam springs itself may be one or more contoured configuration areas. However, other arrangements of bridges may be utilized. Exemplary bridges containing the same types of foam springs are depicted in mappings 422 and 426 of FIG. 8B. The bridge contains a pattern of foam layers in the middle which separates the left side of the mattress mapping from the right side of the mattress mapping.

Figure 8D:
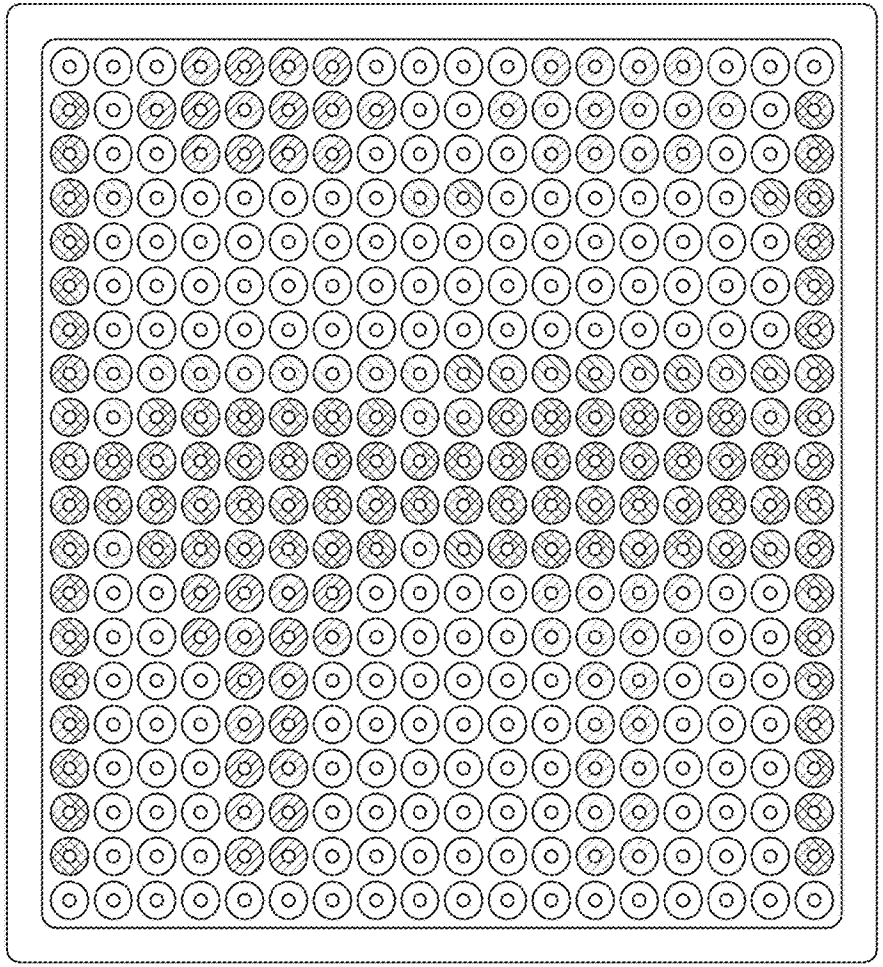
Figure 8C:
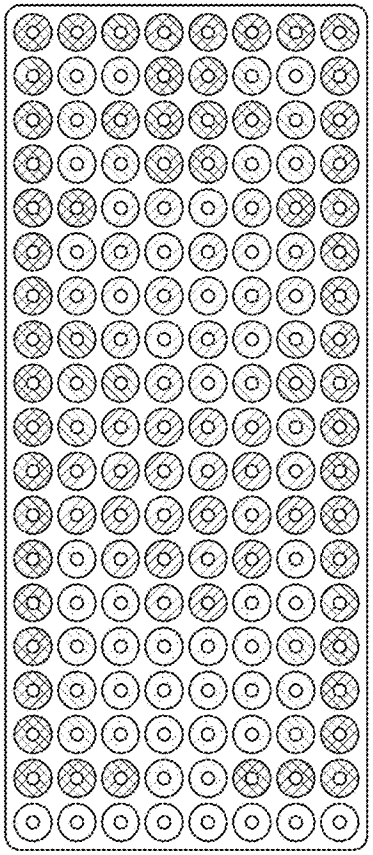

FIG. 8C illustrates a mapping 430. Mapping 430 may be generated by central server system 4104 based on a mapping obtained from storage device 4110. Mapping 430 may be an image formatted by central server system 4104 to contain aesthetically appealing graphic(s) which may be transmitted to user device 4102 (and viewable by the user via display device 4116).

FIG. 8D illustrates a mapping 432. Mapping 432 may be generated by central server system 4104 based on a mapping obtained from storage device 4110. Mapping 432 may be an image formatted by central server system 4104 to contain aesthetically appealing graphic(s) which may be transmitted to user device 4102 (and viewable by the user via display device 4116). The mappings provided in FIGS. 8A-8D contains exemplary mappings and other types of mappings may be used.

Figure 5C:
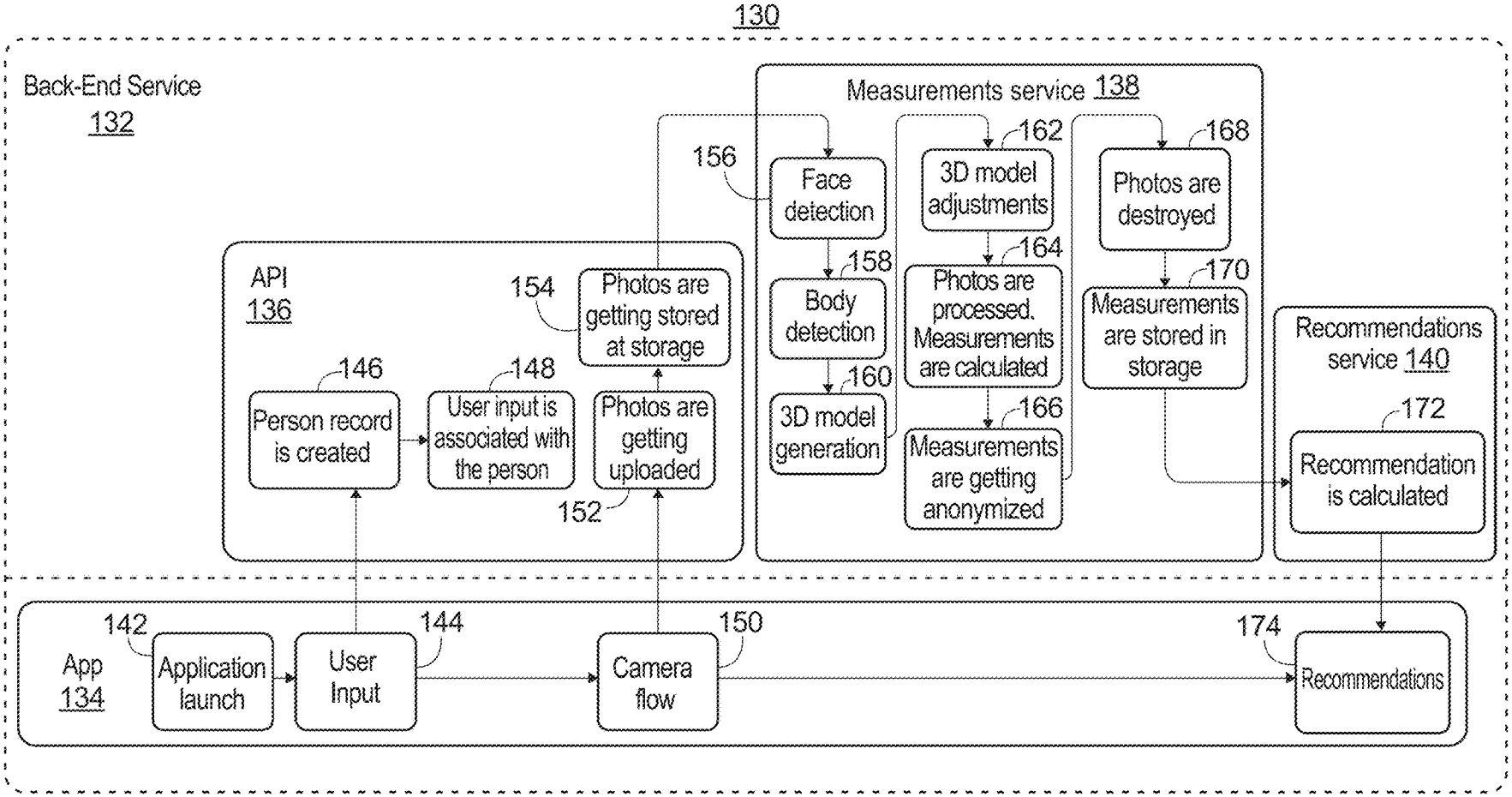
FIG. 5C illustrates a block diagram depicting components for obtaining generalized consumer proportional dimension data in accordance with an implementation of the present disclosure.

In an implementation, generalized consumer proportional dimension data may be an image generation server as depicted in FIG. 5C. Specifically, FIG. 5C illustrates a block diagram 130 depicting components for obtaining generalized consumer proportional dimension data. Block diagram 130 includes a back-end service 132, an app 134, an API 136, a measurement service 138, and a recommendations service 140.

Back-end service 132, app 134, API 136, measurements services 138, and/or recommendations service 140 may include processing logic that comprises hardware (e.g., circuitry, dedicated logic, programmable logic, microcode, etc.), software (e.g., instructions run on a processing device to perform hardware simulation), or a combination thereof. Back-end service 132 may run on central server system 4104 depicted in FIG. 5A or elsewhere.

App 134 may be an app or web-based application that runs on user device 102 depicted in FIG. 5A or elsewhere.

API 136 defines interactions between software application(s) and/or mixed hardware-software intermediaries. API 136 may gather data and/or communicate unidirectionally or bidirectionally with other applications and May run on central server system 4104 depicted in FIG. 5A or elsewhere.

Measurements service 138 may run on image generation server 4114 depicted in FIG. 5A or elsewhere.

Recommendations service 140 may run on central server system 4104 depicted in FIG. 5A or elsewhere.

Suppose a user (John) is asked to input generalized consumer proportional dimension data in order to order a custom mattress. For example, John may be provided with interface 232 as depicted in FIG. 6C which requests that John selects the option to take photo(s) via the photo scanning app. John may launch his application as shown in block 142 in FIG. 5C. In block 144, John may provide user input such as his name, user identification, etc. The user input is transmitted by app 134 to API 136. In block 146, API 136 creates a person of record.

In block 148, API 136 associates the user input with the person (John). Such association(s) may be stored in a database.

John may then be asked to capture one or more pictures using his mobile device's camera. In block 150, app 134 obtains access to the device's camera and receives camera flow input (i.e., in the form of a captured photograph(s)). App 134 then transmits the camera flow input to API 136. In block 152, API 136 receives or otherwise uploads the photograph(s). At block 154, API 136 stores the photograph (s) at a storage device 4110. The storage device may be any device that stores photographs. The photographs are securely stored and may not have any identification information or coded/anonymous identification information.

API 136 then transmits the photograph(s) to measurements services 138. In block 156, measurements service 138 performs face detection on the photograph(s). In block 158, measurements services 138 perform body detection on the photograph(s). In block 160, measurements services 138 generates a 3D model of the face and/or body. In block 162, measurements services 138 performs adjustments to the 3D model. Such adjustments include accounting for any missing or distorted body portions, determining (and eliminating, as needed) any errors in the body portions, etc. In block 164, measurements services 138 then process the photograph(s) and calculates measurements. For example, measurements services 138 may calculate the generalized proportion dimension data from the photograph(s). In block 166, measurements services 138 scrubs or otherwise anonymizes the measurements so they are general and not specific to a person's photograph(s). In block 168, measurements services 138 then destroys the photograph(s). The deletion of photographs is performed in a secure manner and is permanent. In block 170, measurements services 138 stores the measurements in a storage. The storage may include a database.

Measurements services 138 transmits only the measurements from storage to recommendations service 140. In block 172, recommendations service 140 calculates a recommendation for a mattress/foam type best suited for the user in view of the generalized proportion dimension data and in block 174, the recommendations are transmitted by recommendations service 140 back to app 134. In other implementations, the recommendations may include generalized proportion dimension data itself. App 134 may then use the recommendation along with other information to generate the best mattress mapping for the user.

Figure 9:
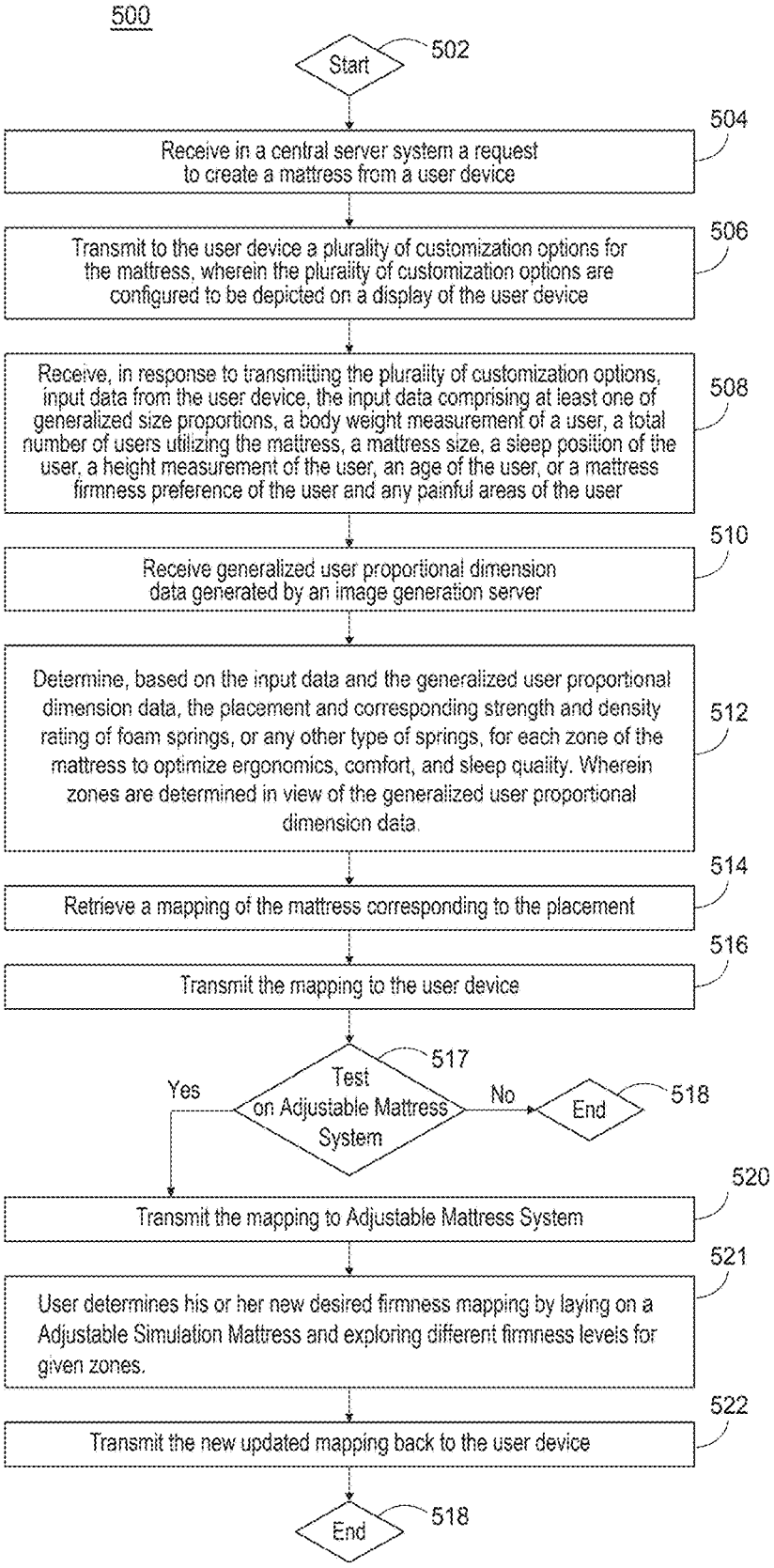
FIG. 9 is a flow diagram illustrating a method of customizing a mattress using an image generation server in accordance with an implementation of the present disclosure.

FIG. 9 is a flow diagram illustrating a method 500 of customizing a mattress using an image generation server, according to an implementation of the present disclosure. The method 500 may be performed by processing logic that comprises hardware (e.g., circuitry, dedicated logic, programmable logic, microcode, etc.), software (e.g., instructions run on a processing device to perform hardware simulation), or a combination thereof.

For simplicity of explanation, the methods of this disclosure are depicted and described as a series of acts. However, acts in accordance with this disclosure can occur in various orders and/or concurrently, and with other acts not presented and described herein. Furthermore, not all illustrated acts may be required to implement the methods in accordance with the disclosed subject matter. In addition, those skilled in the art will understand and appreciate that the methods could alternatively be represented as a series of interrelated states via a state diagram or events. Additionally, it should be appreciated that the methods disclosed in this specification are capable of being stored in an article of manufacture to facilitate transporting and transferring such methods to computing devices. The term "article of manufacture," as used herein, is intended to encompass a computer program accessible from any computer-readable device or storage media. In one implementation, method 500 may be performed by a central server system (e.g., central server system 4104) as shown in FIG. 5A.

As illustrated, method 500 starts at block 502. At block 504, a request is received in a central server system 4104 to create a mattress. The request is sent from a user device 4102. For example, as depicted in FIG. 5A, central server system 4104 receives a request to create a mattress. The request is sent from user device 4102. A user employing user device 4102 may send a request to central server system 4104 to create the mattress in any of a variety of ways. For example, the user may access a website on a web browser, click on a link, access a mobile app, etc., in order to create the mattress.

Referring again to FIG. 9, at block 506, a plurality of customization options for the mattress are transmitted to the user device 4102. The plurality of customization options is configured to be depicted on a display device 4116 of the user device 4102. For example, as depicted in FIG. 5A, central server system 4104 transmits multiple customization options to user device 4102 and the customization options are configured to be displayed on display device 4116 of user device 4102. Some customization options are shown in FIGS. 6A6C.

Referring again to FIG. 9, at block 508, in response to transmitting the plurality of customization options, input data is received from the user device. The input data comprises at least one of generalized size proportions, a body weight measurement of a user, a total number of users utilizing the mattress, a mattress size, a sleep position of the user, a height measurement of the user, an age of the user, or a mattress firmness preference of the user.

For example, as depicted in FIG. 5A, central server system 4104 receives input data from user device 4102 in response to transmitting the multiple customization options. The input data includes one or more of generalized size proportions, a body weight measurement of a user, a total number of users utilizing the mattress, a mattress size, a sleep position of the user, a height measurement of the user, an age of the user, or a mattress firmness preference of the user.

Referring again to FIG. 9, at block 510, generalized consumer proportional dimension data generated by an image generation server is received in the central server system 4104. For example, as depicted in FIG. 5A, central server system 4104 receives generalized consumer proportional dimension data generated by image generation server 4114.

Referring again to FIG. 9, at block 512, based on the input data and the generalized consumer proportional dimension data, and the user's preferred firmness settings from the Adjustable mattress system 100, firmness in at least one of a plurality of ergonomic contoured configuration areas or zones 118 is determined. The firmness in at least one of a plurality of ergonomic contoured configuration areas or zones 118 may be determined to match the consumer's tactile experience with the adjustable mattress system 100 and the expected tactile experience with the final customized non-adjustable mattress. Each zone includes a corresponding strength and density rating, which is achieved by adjusting fluid pressure of the inflatable bladders 110 and/or the volume of fluid in the corresponding zone. A first ergonomic contoured configuration area or zone of the multiple ergonomic contoured configuration areas or zones is determined in view of the generalized consumer proportional dimension data. The strength rating may also be referred to as firmness.

Referring again to FIG. 9, at block 514, a mapping of the mattress corresponding to the placement is retrieved. For example, as depicted in FIG. 5A, central server system 4104 retrieves the mapping of the mattress corresponding to the placement of the foam springs from storage device 4110.

Referring again to FIG. 9, at block 516, the mapping is transmitted to the user device 4102. For example, as depicted in FIG. 5A, central server system 4104 transmits the mapping to user device 4102. User device 4102 May provide the mapping for display to the user on display device 4116. The method then ends at block 518.

Referring again to FIG. 9, at block 517, the user may choose to test (or not) the mapping on the Adjustable Mattress System 100 adjustable. If the user chooses not to test the mapping, the method ends at block 518. In a case wherein the user chooses to test the mapping on the Adjustable Mattress System 100, the mapping is transmitted to the Adjustable Mattress System 100 at block 520 and the Adjustable Mattress System 1001 inflates the inflatable bladders 110 according to the mapping.

Referring again to FIG. 9, at block 521, the user can test the mapping and adjust the firmness of the zones 118 of the Adjustable Simulation Mattress 101. For example, the user can use the Remote control 4210 to adjust the firmness of different zones 118 of inflatable bladders 110.

Referring again to FIG. 9, at block 522, the new adjusted mapping may be transmitted back to user device 4102 and in the next step, the method may end at block 518.

In some implementations, central server system 4104 may retrieve tables corresponding to the mappings along with the mappings of mattresses from storage device 4110. Additionally, mattress layer architectures (e.g., mattress layer architecture 314) may also be stored by storage device 4110. Therefore, a mattress layer architecture indicative of one or more mattress layers may be retrieved by central server system 4104.

FIG. 9 describes customization of a mattress based on generalized consumer proportional dimension data provided by image generation server 4114. In other implementations, user device 4102 and not image generation server 4114 may provide the same or similar generalized consumer proportional dimension data to central server system 4104. This implementation is described below with respect to FIG. 10. In yet other implementations, the generalized consumer proportional dimension data may be provided by both image generation server 4114 and user device 4102.

Figure 10:
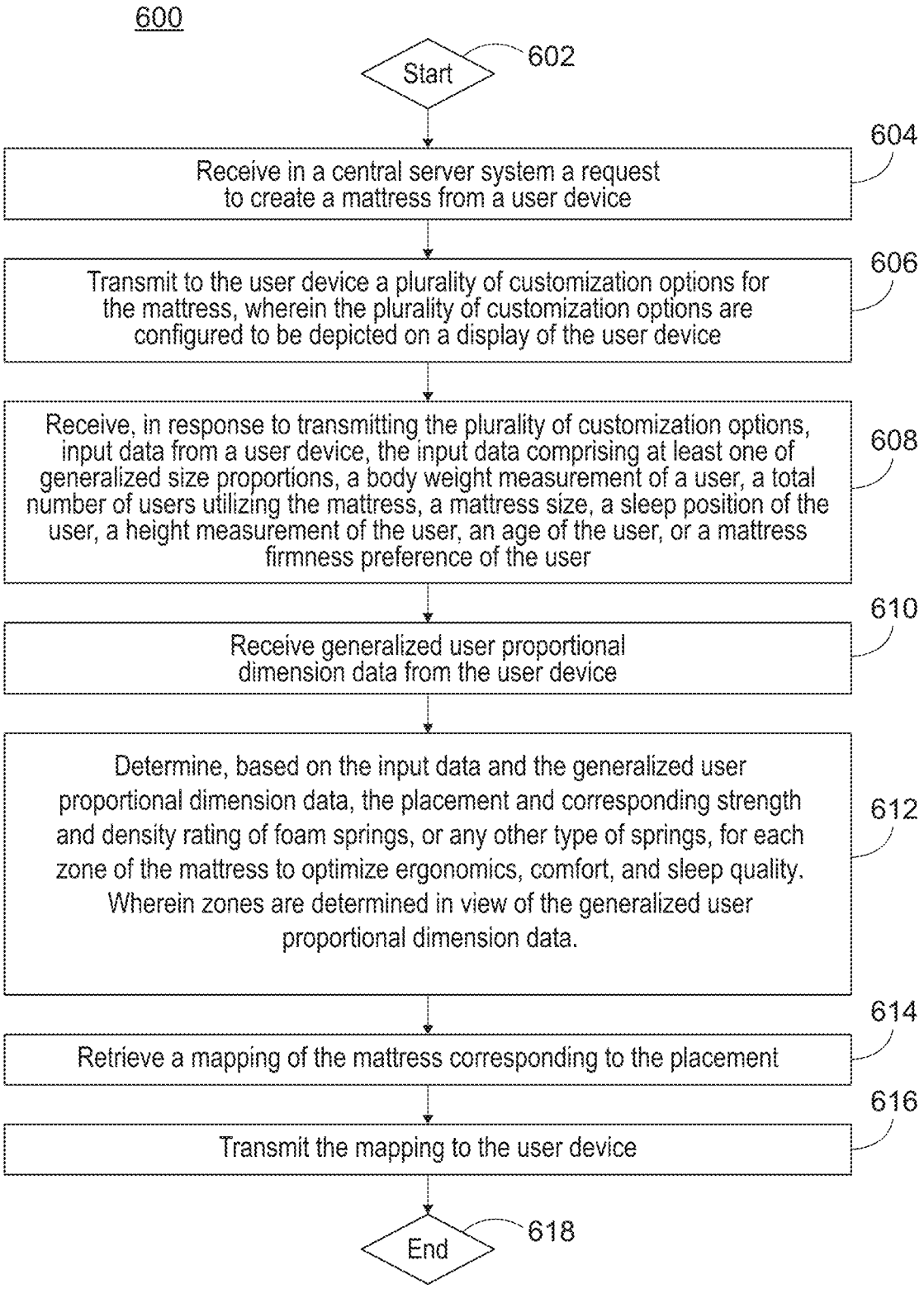
FIG. 10 is a flow diagram illustrating a method of customizing a mattress using generalized consumer proportional dimension data provided by the user device in accordance with an implementation of the present disclosure.

FIG. 10 is a flow diagram illustrating a method 600 of customizing a mattress using generalized consumer proportional dimension data provided by the user device 4102. The method 600 may be performed by processing logic that comprises hardware (e.g., circuitry, dedicated logic, programmable logic, microcode, etc.), software (e.g., instructions run on a processing device to perform hardware simulation), or a combination thereof.

For simplicity of explanation, the methods of this disclosure are depicted and described as a series of acts. However, acts in accordance with this disclosure can occur in various orders and/or concurrently, and with other acts not presented and described herein. Furthermore, not all illustrated acts may be required to implement the methods in accordance with the disclosed subject matter. In addition, those skilled in the art will understand and appreciate that the methods could alternatively be represented as a series of interrelated states via a state diagram or events. Additionally, it should be appreciated that the methods disclosed in this specification are capable of being stored in an article of manufacture to facilitate transporting and transferring such methods to computing devices. The term "article of manufacture," as used herein, is intended to encompass a computer program accessible from any computer-readable device or storage media. In one implementation, method 600 may be performed by a central server system (e.g., central server system 4104) as shown in FIG. 5A.

As illustrated, method 600 starts at block 602. At block 604, a request is received in a central server system 4104 to create a mattress. The request is sent from a user device 4102. For example, as depicted in FIG. 5A, central server system 4104 receives a request to create a mattress. The request is sent from user device 4102. A user employing user device 4102 may send a request to central server system 4104 to create the mattress in any of a variety of ways. For example, the user may access a website on a web browser, click on a link, access a mobile app, etc., in order to create the mattress.

Referring again to FIG. 10, at block 606, a plurality of customization options for the mattress are transmitted to the user device 4102. The plurality of customization options is configured to be depicted on a display device 4116 of the user device 4102. For example, as depicted in FIG. 5A, central server system 4104 transmits multiple customization options to user device 4102 and the customization options are configured to be displayed on display device 4116 of user device 4102. Some customization options are shown in FIGS. 8A-8D.

Referring again to FIG. 10, at block 608, in response to transmitting the plurality of customization options, input data is received from the user device 4102. The input data comprises at least one of generalized size proportions, a body weight measurement of a user, a total number of users utilizing the mattress, a mattress size, a sleep position of the user, a height measurement of the user, an age of the user, or a mattress firmness preference of the user.

For example, as depicted in FIG. 5A, central server system 4104 receives input data from user device 4102 in response to transmitting the multiple customization options. The input data includes one or more of generalized size proportions, a body weight measurement of a user, a total number of users utilizing the mattress, a mattress size, a sleep position of the user, a height measurement of the user, an age of the user, or a mattress firmness preference of the user.

Other input data may be considered including a location of pain experienced by the user, disturbed sleep (disruptions in sleep, lack of proper amount of sleep), snoring, etc. The location of pain may indicate that a user requires a particular type of foam in a contoured configuration area. For example, if the user has lower back pain, it may be beneficial to provide a contoured configuration area that corresponds to the area where the user's lower back would fall on the mattress mapping that has a particular firmness determined to ease back pain. Location of aches and pains that are input by the user enables alteration of the firmness of corresponding contoured areas. In other implementations, users may be able to determine softer or former areas in particular areas of the mattress mappings and override the suggested mattress mapping.

Referring again to FIG. 10, at block 610, generalized consumer proportional dimension data is received from the user device 4102. For example, as depicted in FIG. 5A, central server system 4104 receives generalized consumer proportional dimension data from user device 4102.

Referring again to FIG. 10, at block 612, based on the input data and the generalized consumer proportional dimension data, and the user's preferred firmness settings from the Adjustable Mattress System 100, firmness placement of the hybrid elements 104 in at least one of a plurality of ergonomic contoured configuration areas or zones 118 is determined. The placement of firmness zones 118 corresponding to the hybrid elements 104 in at least one of a plurality of ergonomic contoured configuration areas or zones may be determined to match the consumer's tactile experience with the Adjustable Mattress System 100 and the expected tactile experience with the final customized non-adjustable mattress. Each zone includes a corresponding strength and density rating, which is achieved by adjusting the fluid pressure of the inflatable bladders 110 and/or the volume of fluid in the corresponding zone in the inflatable bladders. A first ergonomic contoured configuration area or zone of the multiple ergonomic contoured configuration areas or zones 118 is determined in view of the generalized consumer proportional dimension data. The strength rating may also be referred to as firmness.

placement of a first type of foam springs, and/or a second type of foam springs and/or a third type of foam springs in at least one of a plurality of ergonomic contoured configuration areas or zones 118 may be determined. The placement of a first type of foam springs, and/or a second type of foam springs and/or a third type of foam springs in at least one of a plurality of ergonomic contoured configuration areas or zones 118 may be determined to match the consumer's tactile experience with the mattress expected by the online store. Each of the first type of foam springs, the second type of foam springs and the third type of foam springs comprises a corresponding strength/firmness and density rating. A first ergonomic contoured configuration area of the plurality of ergonomic contoured configuration areas is determined in view of the generalized consumer proportional dimension data. For example, as depicted in FIG. 5A, central server system 4104 determines placement of a first type of foam springs, a second type of foam springs and a third type of foam springs in at least one of multiple ergonomic contoured configuration areas based on the input data and the generalized consumer proportional dimension data. Each of the first type of foam springs, the second type of foam springs and the third type of foam springs includes a corresponding strength and density rating. A first ergonomic contoured configuration area of the multiple ergonomic contoured configuration areas is determined in view of the generalized consumer proportional dimension data.

Referring again to FIG. 10, at block 614, a mapping of the mattress corresponding to the placement is retrieved. For example, as depicted in FIG. 5A, central server system 4104 retrieves the mapping of the mattress corresponding to the placement of the foam springs from storage device 4110.

Referring again to FIG. 10, at block 616, the mapping is transmitted to the user device 4102. For example, as depicted in FIG. 5A, central server system 4104 transmits the mapping to user device 4102. User device 4102 may provide the mapping for display to the user on display device 4116. The method then ends at block 618.

Implementations described herein may apply to either or both of the methods described by method 500 and method 600.

In an implementation, the generalized consumer proportional dimension data includes one or more of the following: a distance between hips and shoulders of the user, a height of the user, a shoulder width, weight, or a hip circumference.

In an implementation, each of the multiple ergonomic contoured configuration areas include one of the first type of foam springs, the second type of foam springs, or the third type of foam springs.

In an implementation, central server system 4104 depicted in FIG. 5A receives a confirmation from user device 4102 to purchase the mattress in view of the mapping. For example, after the user receives the mapping, the user may be satisfied with the mapping and wish to purchase the mattress. The user may purchase the mattress in any of a variety of ways. For example, a user may review his/her shopping cart and check out and submit payment. After central server system 4104 receives confirmation of the payment, central server system 4104 provides the mapping to mattress production device 4112 to produce the mattress.

In another implementation, wherein prior to receiving the confirmation, central server system 4104 receives a modification of the mapping. For example, the user may review the mapping and decide to modify it. The user may modify the mapping by going back to one of the customization options depicted on display device 4116 and change his/her responses. Otherwise, the user may select the mapping and modify the placement of any of the ergonomic contoured configuration areas and/or the foam types of foam springs. Central server system 4104 may then provide the modification to the mapping to mattress production device 4112.

As described above, the modification to the mapping may include a modification to one or more of the multiple ergonomic contoured configuration areas including a modification of the placement of one or more of the first type of foam springs, the second type of foam springs, or the third type of foam springs.

In an implementation, central server system 4104 generates a code in view of the input data and the customized options. However, the code may be modified, or a new code may be created based on the input data, the customized options, and/or input provided by a neural network, as described herein. Additionally, the mattress mappings themselves may be updated by the neural network 4124, as shown in conjunction with FIG. 12, and used to create customized mattresses for future users as described herein. The mattress mappings may be updated as more consumer data is collected to continually refine selection and contouring. Updating of mattress mapping may be performed manually or via neural network 4124. In an implementation, the code refers to (and is based on) the variables input by the consumer and that code is then used to determine the subsequent parts used to personalize the mattress-by-mattress production device 4112 (or other device).

The code generated by central server system 4104 may contain an indication of one or more predefined mappings recognized by the online store as matching the pattern of consumer input data. The generated code may contain one or more mappings created or otherwise acquired by the online store from one or more initially predefined mappings. Accordingly, the mappings of the unique and/or customized mattress may be based on static and/or adaptive pattern recognition. In order to customize mattresses based on static and/or adaptive pattern recognition, artificial intelligence may be implemented via neural network 4124. Therefore, based on the training neural network 4124, customized mattresses that suit users in view of their input data and/or customized options can be provided.

Neural network 4124 may be a computational tool capable of recognizing patterns, making predictions, identifying outliers, and/or identifying alterations based on past input/mistakes. Inclusion of neural network 4124 within system architecture 4100 may enable the online store to better anticipate a user's tactile experience. Training neural network 4124 with user feedback, such as survey responses, may enable adaptive pattern recognition allowing for better anticipation of a consumer's tactile experience from consumer input data. Extending the training by allowing neural network 4124 to correct for consistent tactile insufficiencies may enable the creation of derivative mappings to be stored within storage device 4110. Allowing neural network 4124 to increase its reward during training by taking the action of identifying and excluding customers may enable the identification of consumer populations not served by the predefined and/or derived mappings stored within storage device 110. In so doing, neural network 4124 may motivate the creation of new mappings.

Figure 11:
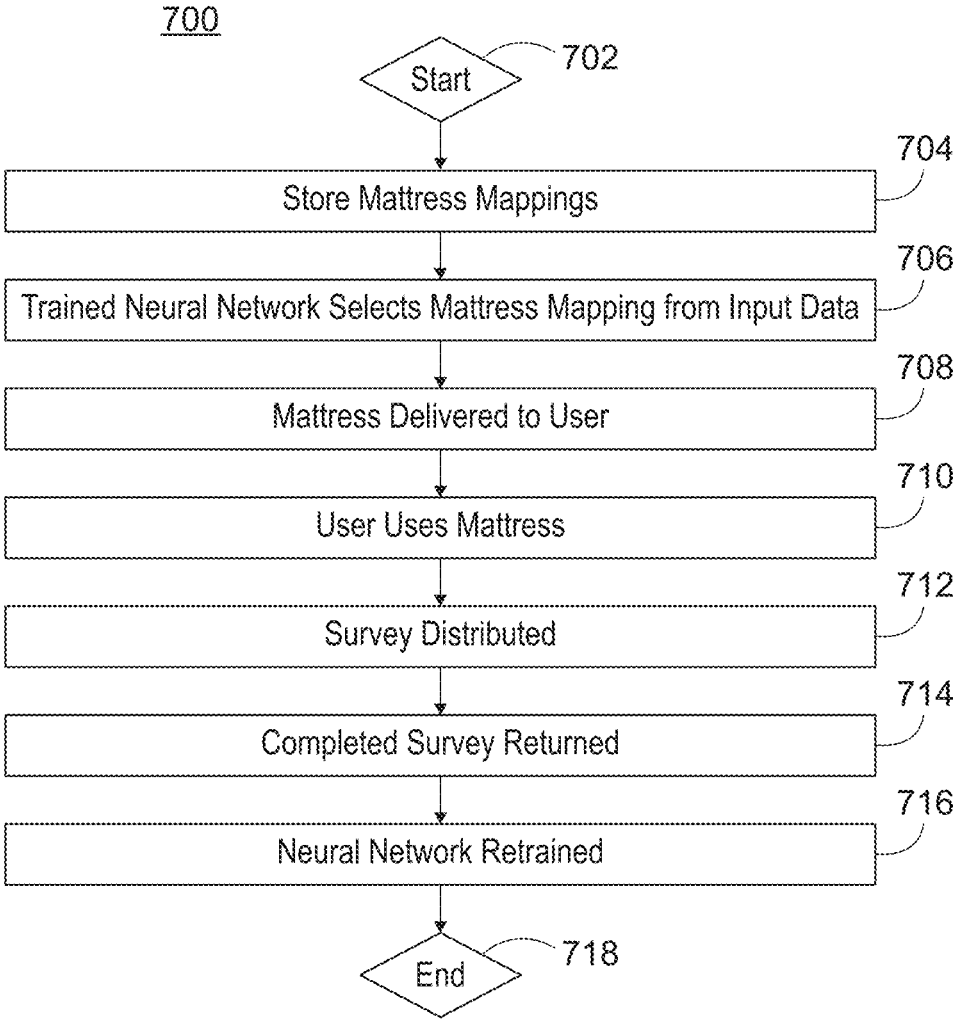
FIG. 11 is a flow diagram illustrating a method of providing a customized mattress utilizing a trained neural network in accordance with an implementation of the present disclosure.

Details regarding input and output of a neural network used to create artificially intelligent customized mappings are described herein with respect to FIGS. 11-15. FIG. 11 is a flow diagram illustrating a method 700 of providing a customized mattress utilizing a trained neural network, such as neural network 4124.

Referring now to FIG. 11, the method starts at block 702. At block 704, an initial set of mattress mappings (each of which includes a mapping of foam springs and/or foam layers) designed to provide a believed optimal tactile experience to one or more suspected subsets of users are stored. A believed optimal tactile experience is one that is predicted by a developer for a user.

The mattress mappings may be stored in storage device 4110 or elsewhere. The input data received at central server system 4104 is then provided to trained neural network 4124 as input enabling neural network 4124 to select the mattress mapping from best corresponding with the input data, as indicated by block 706. Training a neural network may be accomplished using any algorithm allowing a neural network to associate input data corresponding to the one or more suspected subsets of users with the mattress mapping designed to provide a believed optimal tactile experience for each of the subsets. Accordingly, a neural network may be trained to associate input data with the mattress mapping believed to provide the user with an optimal tactile experience. As input data is a pattern comprising preferred generalized proportion dimension data and entered customization options corresponding to a mattress mapping defined by a mattress code, neural network 4124 may be trained with utilizing a pattern recognition algorithm (e.g., backpropagation, etc.). Regardless of how trained, neural network 4124 provides users within one of more the suspected subsets a mattress containing an initially matched mapping, as depicted by block 708. The mattress may be given as the result of purchase, gift, participation in trial program, etc. The means of conveyance may not be of particular importance, so long as it provides the recipient with an opportunity to use the mattress, as depicted in block 710. Specifically, in block 710, a user uses the mattress (e.g., lays on it, sleeps on it, tests it out, etc.).

After using the mattress, the user receives a survey distributed by central server system 4104 in block 712 to rate his/her tactile experience. The rating may be obtained from a variety of questions, such as experience of pain, perception of firmness, quality of sleep, rating of comfort, support, and ability to fall asleep. Additional information regarding the surveys is described herein.

Upon completion of the survey, as shown in block 714, the survey is returned by the user. Specifically, central server system 4104 receives the completed survey from user device 4102. Completed surveys are then used to retrain neural network 4124 at block 716, changing the selection algorithm to better anticipate the tactile impression of future customers/users. The method ends at block 718.

In an implementation, neural network 4124 may be trained/retrained as to recognize patterns within the input data and/or customized options distinguishing users from their initial suspected subset, such that the neural network selects a different predefined mapping, or none at all, for users not having an acceptable tactile experience. The retraining may be accomplished using anyone or more of a variety of learning algorithms, such as backpropagation or reinforcement learning. Reinforcement learning is a type of machine learning technique that enables an agent to learn in an interactive environment by trial and error using feedback from its own actions and experiences. Reinforcement learning has an input and uses rewards and punishment as signals for positive and negative behavior. A state is defined as the current situation of the agent.

When reinforcement learning is employed, the state will be the input data provided by the user, the action will be paring a user input data with a mapping stored in storage device 4110, and the reward will be a survey score provided by the consumer after using the mattress. The goal would be to minimize potential negative user(s)' ratings (submitted, for example, via survey responses) and to maximize potential favorable ratings.

In order to maximize a score assigned to user satisfaction based on the user(s)' ratings, during retraining with survey data and score neural network 4124 may learn to take actions not tolerated in retail. Selling products such as mattresses to consumers is the goal of retail businesses, whether the businesses sell mattresses online or via brick-and-mortar locations. For example, when a customer enters a store, accordingly, refusing to sell them a product if it is predicted that the customer would assign a low user rating to a product would generally be a negative action which is not rewarded. Contrary to the negative reward of losing a sale, during retraining neural network 4124 may learn not to associate a certain subset of users with any of the stored mappings, and thereby learn not sell such customers a mattress.

Another negative retail behavior that may be considered during retraining is not listening to the customer. Generally, not listening to customers and ignoring one or more of his/her customization requests is generally considered a negative retail action. In order to maximize survey score reward, neural network 4124 may learn to ignore certain or all requests from certain groups of consumers when selling them a mattress. The subsets of consumers neural network 4124 learns to ignore and/or not listen to may be identified, as to provide designers the opportunity to develop new mattress mappings providing a more positive tactile experience. After establishing new mappings, the neural network can be retrained to associate the subset of ignored and/or not listened to consumers with the new mattress mappings.

Although mappings of mattresses are described generally, it is respectfully submitted that mappings may specifically include mappings of foam springs (for example, as shown in third layer 320 of FIG. 7B) or mappings that include one or more layers.

In an implementation, retraining neural network 4124 may utilize user supplied data in response to a user(s)' survey. The consumer may be supplied with the survey after having used his/her newly created customized matters (e.g., after block 710 of FIG. 11).

For example, a survey may request information such as the following from consumers: (A) In comparison to previous mattress, did your newly created customized mattress improve overall comfort, sleep quality and does user feel supported? (B) Did your newly created customized mattress match user expectations on the firmness rating that you supplied? (C) If the left and the right sides of your newly created customized mattress included configurations that had different spring positions (and layers), is the middle of the mattress suitable for your needs/if there is a bridge of springs separating the left and the right sides, are both users happy with the mattress? (D) Are there any discomfort points that you're experiencing (shoulders, hips, legs/knees, etc.)? (E) If you could change any of the foam springs in your mattress, would you change the hardness on any part of the mattress? (F) What was your first impression when you received and opened your newly created customized mattress? (G) How was your first night's sleep on your newly created customized mattress? (H) How comfortable did you find your newly created customized mattress? (I) How does your new mattress live up to your expectations of what you thought a customized mattress would be like? (J) Do you feel you have been able to fall asleep faster on your newly created customized mattress? (K) Do you feel you are getting more restful, deeper sleep with your newly created customized mattress? (L) Do you feel your newly created customized mattress is helping you sleep for longer periods of time? (M) Can you tell us what you most like about N) How satisfied are you with your newly created customized mattress? (O) If satisfied, can you tell us what elements of your newly created customized mattress you are most satisfied with? (P) If dissatisfied, can you tell us what elements of your newly created customized mattress you are most dissatisfied with? (Q) How likely would you buy another customized mattress? (R) What would you be prepared to pay for a newly created customized mattress? (S) How likely is it that you would recommend a customized mattress to friends and family, now that you have tried it?

The consumer may input responses by selection of predetermined responses, input of textual responses, input of a scaled numerical response (e.g., a selection of a number from 0 to 10, etc.) or by other means. The responses may be transmitted from user device 4102 to central server system 4104 via network 4105, as depicted in FIG. 5A.

Referring again to FIG. 11, although not depicted, block 716 may be recursive, that is, retraining of neural network 4124 may be continuous and/or updated sporadically, as new as additional information is received (e.g., as additional survey response is returned in block 714). In an implementation, the retraining may be performed dependent upon receipt of such additional information. In another implementation, the retraining may be performed on a predetermined scheduled basis. Other implementations for retraining may exist. Thus, the recursive nature of block 716 may be dependent on a variable (having a temporal dependency, etc.) and may be repetitive. Details regarding retraining are described herein with respect to FIG. 14.

Figure 12:
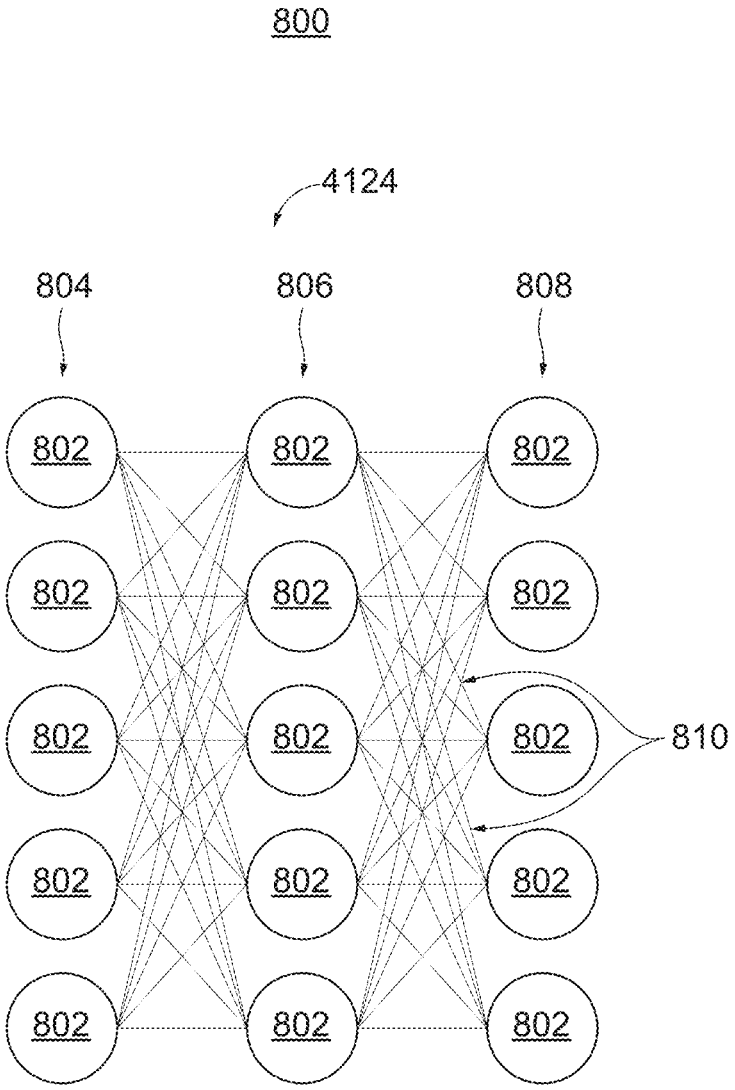
FIG. 12 is a block diagram illustrating an exemplary neural network that may be used to anticipate a user's tactile experience in accordance with an implementation of the present disclosure.

FIG. 12 is a block diagram 800 illustrating an exemplary neural network that may be used to anticipate a user's tactile experience. Neural network 4124 depicted in FIG. 5A may be the same or similar to or differ from neural network 4124 depicted in FIG. 12. The implementation of neural network 4124 depicted in FIG. 12 contains a series of nodes 802 arranged in layers: an input layer 804, a hidden layer 806, and an output layer 808. The nodes of each layer are connected by a series of weighted connections 810. In some instances, more than one hidden layer may be disposed between input layer 804 and output layer 808. It is also possible that no hidden layer is present.

Regardless of the presence or absence of hidden layers, neural network 4124 transforms the consumer-provided input data received at input layer 804 into a mattress code retrievable from output layer 808 via weighted connections 810.

Fewer or greater layers and/or fewer or greater nodes than depicted in FIG. 12 may be implemented by neural network 4124.

In other implementations, neural network 4124 may include one or both of fully connected layers and/or layers that are not fully connected.

In one example, central server system 4104 and/or neural network 4124 in FIG. 5A may be trained to retrieve the following: mapping 402 when presented with input data representing a user having a distance between their shoulders and hips is less than 60 cm and having a user preference for soft firmness; mapping 406 when presented with input data representing a user having a distance between their shoulders and hips is greater than 60 cm and having a user preference for soft firmness; mapping 410 when presented with input data representing a user having a distance between their shoulders and hips is less than 60 cm and having a user preference for a firm firmness; and mapping 414 when presented with input data representing a user having a distance between their shoulders and hips is less than 60 cm and having a user preference for firm firmness. While various network architectures may be used, the neural network will generally comprise an input layer receiving the input data and an output layer specifying at least the mapping.

Figure 13:
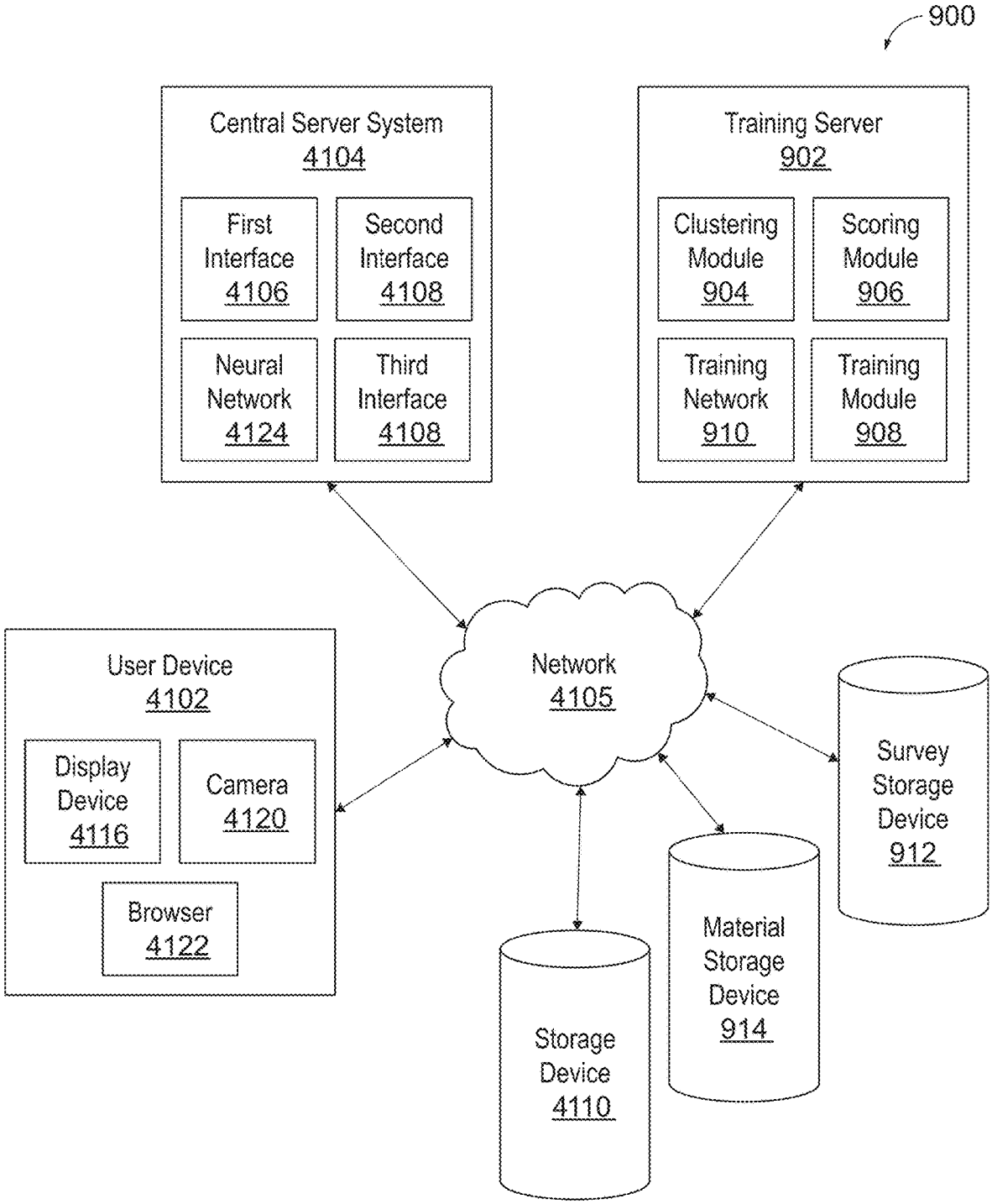
FIG. 13 illustrates an example system architecture for training a neural network to produce a customized mattress in accordance with an implementation of the present disclosure.

Training the online store to recognize input data patterns as corresponding to predefined and/or derived mattress mappings (which includes a mapping of foam springs and/or foam layers) may be accomplished training a neural network to provide adaptive pattern recognition and derivative product selection using a system architecture 900 depicted in FIG. 13. Specifically, FIG. 13 illustrates system architecture 900 for training a neural network to produce a customized mattress. System architecture 900 includes the system architecture 100 of FIG. 5A and description of similar entities depicted by FIG. 5A applies to those depicted by FIG. 13. In some implementations, the system for training a neural network to provide adaptive pattern recognition and/or derivative product selection may be separate from the system architecture of an online store.

System architecture 900 includes a survey storage device 912, and a material storage device 914. Survey storage device 912 and/or material storage device 914 may be a memory (e.g., random access memory), a cache, a drive (e.g., a hard drive), a flash drive, a database system, or another type of component or device capable of storing data. Survey storage device 912 and/or material storage device 914 may also include multiple storage components (e.g., multiple drives or multiple databases) that may also span multiple computing devices (e.g., multiple server computers).

Training of a neural network, such as neural network 4124, is accomplished via a training module 908 of a training server 902. Training server includes a clustering module 904, a scoring module 906, a training module 908, and a training network 910. Training server 902 subjects training of neural network 4124 to a training routine, such as the reinforcement learning algorithm depicted in FIG. 13. To facilitate retraining of neural network 4124 without disrupting operation of an online store, training network 910 may be a copy of neural network 4124 obtained via network 4105. If disruption of operation of the online store is tolerable or preferred, training network 910 may be admitted such that training module 908 operates directly on neural network 4124. Regardless of which neural network is utilized, training server relies upon the operation of clustering module 904 to identify related subsets of costumers, scoring module 906 to assign a score to each cluster based on survey data collected and stored in survey storage device 912, and training module 908 to alter training network 910 to obtain better survey results indicative of improved tactile experiences for future consumers. One possible coordinated operation of these modules is the reinforcement learning algorithm depicted in FIG. 14.

Figure 14:
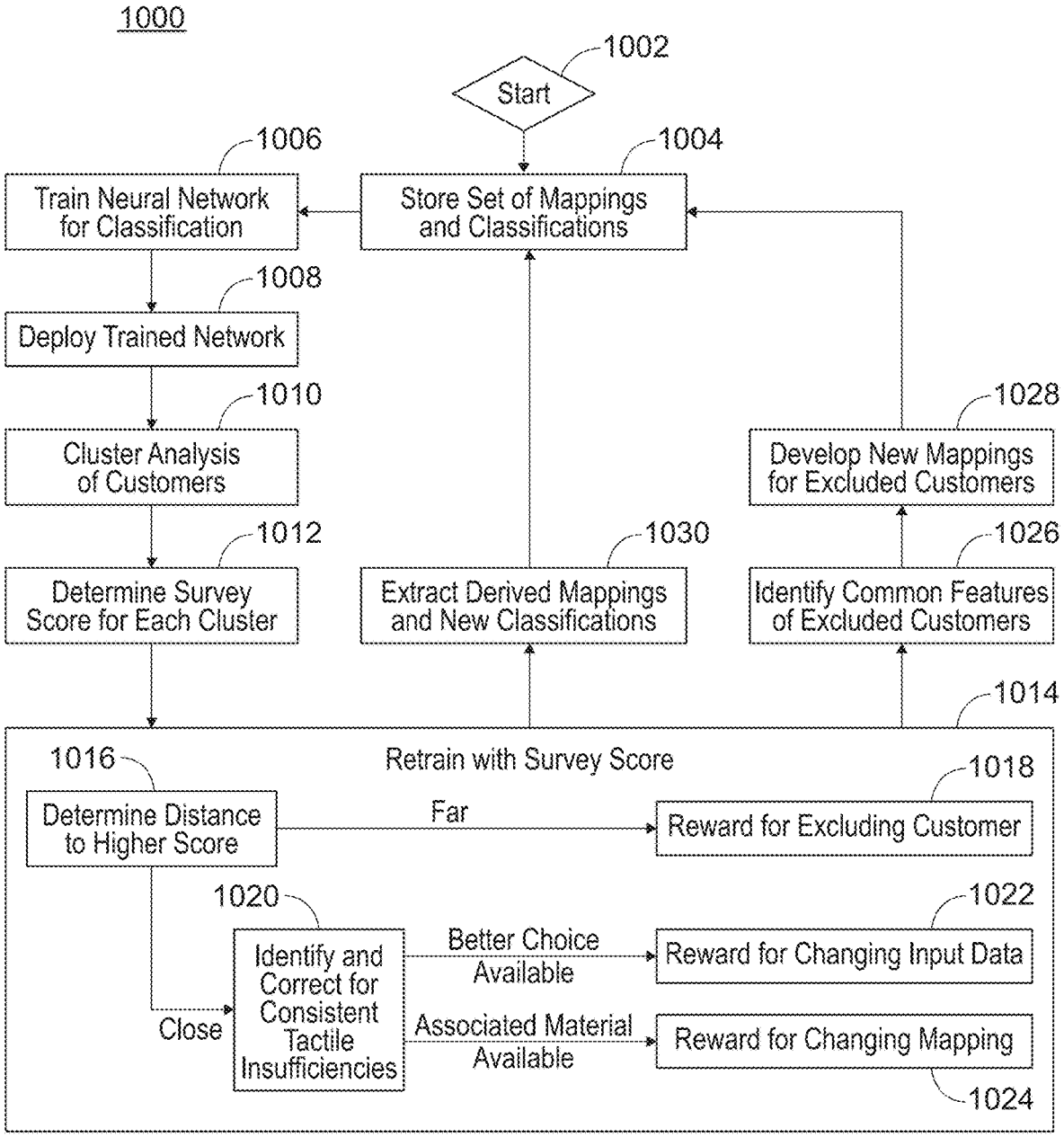
FIG. 14 is a flow diagram illustrating a method of a reinforcement learning algorithm in accordance with an implementation of the present disclosure.

FIG. 14 is a flow diagram illustrating a method 1000 of a reinforcement learning algorithm. The method 1000 may be performed by processing logic that comprises hardware (e.g., circuitry, dedicated logic, programmable logic, microcode, etc.), software (e.g., instructions run on a processing device to perform hardware simulation), or a combination thereof.

For simplicity of explanation, the methods of this disclosure are depicted and described as a series of acts. However, acts in accordance with this disclosure can occur in various orders and/or concurrently, and with other acts not presented and described herein. Furthermore, not all illustrated acts may be required to implement the methods in accordance with the disclosed subject matter. In addition, those skilled in the art will understand and appreciate that the methods could alternatively be represented as a series of interrelated states via a state diagram or events. Additionally, it should be appreciated that the methods disclosed in this specification are capable of being stored in an article of manufacture to facilitate transporting and transferring such methods to computing devices. The term "article of manufacture," as used herein, is intended to encompass a computer program accessible from any computer-readable device or storage media. In one implementation, method 1000 may be performed by a central server system (e.g., central server system 104) as shown in FIG. 1A.

After initializing the reinforcement learning algorithm at start block 1002, a set of mattress mapping classifications of subsets of consumers associated with the various mappings is stored in storage device 110 at block 1004. The classifications may include base classifications comprising relationships between input data and/or generalized consumer proportional dimension data patterns and mappings of mattress that are predicted (e.g., by developers of neural network 4124) to provide a favorable tactile experience. In addition to preset relationships believed by developers to be correct, classifications may include relationships learned by training neural network 4124 either directly or through training network 910 acting as a surrogate during previous training. Previous training refers to past training performed to alter neural network 4124. Regardless of how the classifications are obtained, at block 1006 training network 910 is taught the classification such that it associates consumer input data with the mattress mapping believed to provide the consumer an optimal tactile experience utilizing a pattern recognition algorithm, such as backpropagation.

Referring again to FIG. 15 once trained for the classifications that are present within storage device 4110, training network 910 is deployed at block 1008. If training network 910 is a surrogate of network 4124, deployment may entail transferring training network 910 via network 4105 to central server system 4104 to replace neural network 4124. If training network 910 is neural network 4124 itself, deployment at block 1008 may simply entail launching the online store.

After deployment of training network 910, consumers are sold mattresses based on the operation of neural network 4124 and return completed surveys. Completed surveys returned by customers may be stored in survey storage device 912. After a predetermined threshold is met (e.g., a set amount of time has passed, a set amount of sales have been made, a set amount of surveys have been returned, and/or other conditions indicative of collection of a sufficient amount of data have been met), subsets of customers returning surveys are determined via cluster analysis performed by clustering module 904 at block 1010. The clustering algorithm employed by clustering module 904 May comprise at least one connectivity-based clustering, centroid-based clustering, distribution-based clustering, density-based clustering, and/or density-based clustering, and/or any other algorithm enabling respondent customers to be grouped in terms of degree of similarity with respect to input data provided when ordering a mattress.

After clusters representing subsets of consumers have been identified, scoring module 906 at block 1012 scores the surveys of each consumer within a subset to determine a survey score for each subset (or cluster). The survey score for a cluster may be the average score received by all consumers within the cluster, the median score obtained from all consumers within the subset, and/or any other appropriate metric representing the satisfaction of the cluster as a whole. As input data is multidimensional, the scored clusters of consumers obtained at block 1012 will be dispersed in multidimensional space. For purposes of discussion, the multidimensional space can be simplified to a two-dimensional drawing, such FIG. 15.

Figure 15:
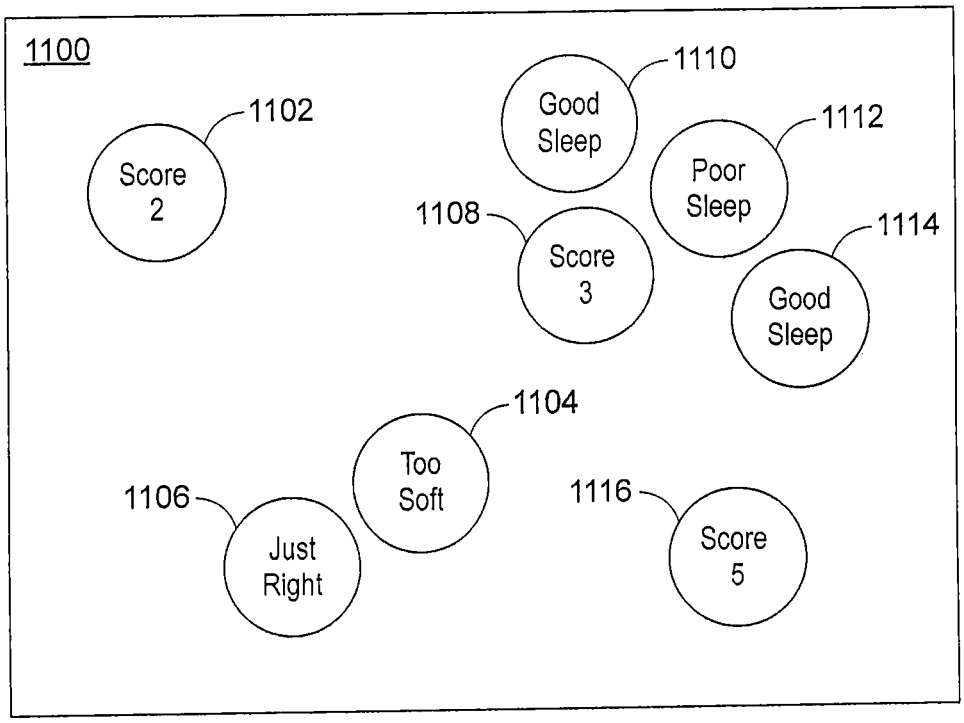
FIG. 15 illustrates a two-dimensional representation of an arrangement of scored clusters of consumers in accordance with an implementation of the present disclosure.

FIG. 15 illustrates a two-dimensional representation of an arrangement 1100 of scored clusters of consumers. As can be seen from FIG. 15, each scored cluster of consumers (clusters 1102-1116) are separated from each other by varying distance. As arrangement 1100 is two-dimensional, the distance is based on differences in an X value and a Y value, such that clusters having similar X and Y value are close to one another. Training module 908 utilizes the distance and difference in score between two clusters to train training network 910 at block 1014 of method 1000.

Referring again to FIG. 14, the training provided by training module at block 1016 begins by determining the distances to the higher scores for each consumer providing a survey. If no clusters are within a predetermined limit, i.e. far away, training module 908 rewards training network 910 for excluding the customer by not selecting a mattress at block 1018. Utilizing a variant of reinforcement learning algorithms, training module 908 determines the value of a reward based on the survey score provided by the consumer.

For example, suppose a consumer named Tom belongs to cluster 1102, which has a cluster score of 2 out of 10 (where 10 is the maximum score, and 1 is a minimum score). Tom's survey score was 1, indicating he had a poor tactile experience. While other clusters have higher scores, none are within the defined limit—i.e., that are all far away. In this scenario, the maximum reward possible for selling a mattress to Tom is the cluster score of 2. Not selling Tom a mattress also provides a reward calculated at block 1018 as the difference between a perfect survey score and the cluster score of cluster 1102. Assuming 10 is a perfect survey score and given the cluster score of cluster 1102 is 2, the reward would be 8. Other methods of assigning a reward for not selling a mattress may be used, so long as the reward for not selling obtained increases as cluster score decreases. Keeping with the example, the maximum score obtainable is 8, indicating a bigger reward would be obtained by not selling someone like Tom a mattress in the future. The values of the weighted connections are then updated to indicate that the association desired from Tom's input data is "no sale". Any algorithm may be used to update the weights according to the desired association, such as backpropagation.

After Tom, training module 908 moves on to the next customer within the training set and determines the distance to a higher score at block 1016 in FIG. 14. If the distance to higher scoring cluster is within a threshold, i.e. close, the training module identifies and corrects for consistent tactile insufficiencies at block 1020. In making this correction, tactile module May compare the actions between the cluster of the current customer of the training set and that of the higher scoring close clusters to determine if there is a "better choice available", and if so, training module 908 rewards training network 910 for changing input data in block 1022. For instance, consider clusters 1104 and 1106. They are very close, meaning the input data is very similar, but have opposite results. Cluster 1106 had the pleasant tactile experience of "just right", while cluster 1104 had the unpleasant experience of "too soft". Correcting for this inconsistency, training module 908 at block 1022 will reward training network 910 for changing the input data by updating the weighted connections such that the association desired from the input data of a consumer of cluster 1104 is a mattress identical to that sold to the members of cluster 1106. Any algorithm May be used to update the weights according to the desired association, such as backpropagation.

A necessary consequence of adjusting the weights of training network 910 to provide the mattress of cluster 1106 when presenting the input data from the members of cluster 1104 is possibly ignoring a preference of the members of cluster 1104. For instance, assume the members of cluster 1106 all requested a firm mattress and the members of cluster 1104 all requested a soft mattress. Adjusting the weights of training network 910 to provide a firm mattress when a soft mattress is requested is training network 910 to ignore the request made by members of cluster 1104 for a soft mattress.

The presence of a "better choice available" is also depicted by the relationship between clusters 1110, 1112, and 1114. When training module 908 reaches a member of cluster 1112, it will determine at block 1016 the distance to the higher scores of clusters 1110 and 1114. Unlike the members of cluster 1112, the members of cluster 1110 and 1114 each reported "good sleep", and thus have higher scores than the "poor sleep" reported by the members of cluster 1112. As the clusters 1110, 1112, and 1114 are adjacent, the distance to each of higher scoring clusters 1110 and 1114 is within a threshold, i.e. close. Accordingly, training module identifies and corrects for the consistent tactile insufficiency at block 1020. In so doing, training module determines if there is a "better choice available" by looking for at least one difference between the mattresses provided to members of cluster 1112 and the mattress provided to clusters 1110 and 1114. For example, assume the members of clusters 1110, 1112, and 1114 only differ with respect to the distance between their hips and shoulders, such that the members of cluster 1110 have distance of 58 cm or less, the members of cluster 1112 have a distance of 59 cm, and members of cluster 1114 have a distance of 60 cm or greater. As noted above, training network 910 may have assigned members of both clusters 1110 and 1112 to a category called the short mattress group. The members of clusters 1110 and 1112, thus, would have each received a mattress identified as a short mattress (and having a corresponding code and/or mattress mapping associated thereto). Receiving nearly identical, if not identical, mattresses and treating the members of cluster 1112 like the members of cluster 1110 would not change the mattress provided to the members of cluster 1112. Failing to change the mattress, treating the members cluster 1112 the same as cluster 1110 does not provide a better choice, but rather the same choice of mattress. Each one receiving a tall mattress, the members of cluster 1114 did receive a different mattress than the members of cluster 1112 as to indicate the presence of a "better choice available". Having a better choice available, training module 908 corrects for tactile insufficiency at block 1022 by rewarding training network 910 to change the user input data by updating the weighted connections such that the members of cluster 1114 are provided a tall, rather than short, mattress.

Eventually training module 908 reaches a member of cluster 1108, who had an unpleasant tactile experience indicating the cluster score of 3. Cluster 1108, as shown in arrangement 1100, is close to higher scoring clusters and 1114. Accordingly, when training modules determine the distance to higher scores at block 1016, it will determine the distance to be "close". It will then determine if a better choice is available by looking for differences between the mattresses provided to the consumers of cluster 1108 and those provided to the customers of clusters 1110 and 1114. Assuming a different mattress was provided to each of clusters 1108, 1110, and 1114, at least two potentially better choices are available. Determining which of the better choices to select, training module 908 will attempt to maximize reward while minimizing work by adjusting the difference in scores between cluster 1108 and cluster 1114 and the differences in scores between clusters 1108 and 1110 by the distance between the respective clusters such that the reward decreases with distance.

At block 1022 training module 908 will correct for tactile insufficiency by rewarding training network 910 to change the user input data by updating the weighted connections such that the members of cluster 1108 are provided the mattress given to the customers of cluster 1114.

Cluster 1116 within arrangement 1100 represents another tactile insufficiency that may be corrected at block 1020. Having a cluster score of 5, consumers of cluster 1116 experience decent, but not perfect sleep. Even if members of clusters 1114 received a different mattress than the members of clusters 1116, to make a "better choice available", the distance between the clusters is such that reward for choosing the better options may be greatly diminished. In such a situation, the maximum reward may be obtained by changing the materials of the mattresses provided to the members of cluster 1116. In making the determination to change materials, and thereby create a derivative mattress mapping, the reward may be determined based on the confidence the change will improve cluster score. For instance, assume the mediocre cluster score of 5 results from several members of cluster 1116 reporting discomfort in similar regions of the body. Further assume the members of cluster 1116 share a similar generalized consumer proportional dimension of wide shoulders and are side sleepers. Training module 908 may have access to data associating discomfort in the neck with the need for a softer mattress. Training module 908 may search and/or query material storage device for a foam softer than the foam utilized in the mattress delivered to the consumers of cluster 1116. Depending on the confidence in the data, the reward for changing the mattress mapping to include the softer material would be dependent would decrease with confidence. For instance, if the data is based on correlation between firmness and neck pain, the amount of reward for making the change may decrease with the correlation coefficient between neck pain and firmness.

Referring again to FIG. 14, if in block 1020 it is determined that the distance to high score determines that there is "associated material available," training module 908 rewards training network 910 for changing mapping in block 1024.

After retraining, derived mappings and new classifications are extracted at block 1030 and stored at block 1004. Similarly, at block 1026 common features of excluded customers are identified. If provided to product development teams, development of new mattress mapping may occur, as indicated by block 1028. Any new mappings and classifications based thereon may be stored at block 1004 in storage device 110. Repeating block 1006, neural network 4124 may be trained on the classification as to enable the store to anticipate a future consumer's tactile experience.

Neural network 4124 may be contained within or otherwise remote and accessible by central server system 104. Neural network 4124 and/or central server system 4104 may be trained to retrieve one of the stored mappings from storage device 4110 when presented with input data and/or generalized consumer proportional dimension data meeting predefined conditions representing a base classification for the training.

Base classifications may include relationships between input data and/or generalized consumer proportional dimension data patterns and mappings of mattress that are predicted (e.g., by developers of neural network 4124) to provide a favorable tactile experience. In addition to preset relationships believed by developers to be correct, base classifications used to train network 4124 may include relationships learned by network 4124 during previous training. Previous training refers to past training performed by neural network 4124.

Regardless of whether including preset relationships based on developer belief and/or relationships determined by central server system 4104 via previous training of neural network 4124, training neural network 4124 for base classification may involve adjusting at least one weight matrix of network 4124 such that presenting input data to the input layer of network 4124 provides an output at the output layer of network 4124 indicative of the mapping related to the input according to the base classifications.

Although central server system 4104 and/or training server 902 are indicated as performing training of neural network 4124, in other implementations, one or more other servers may be used.

Figure 16:
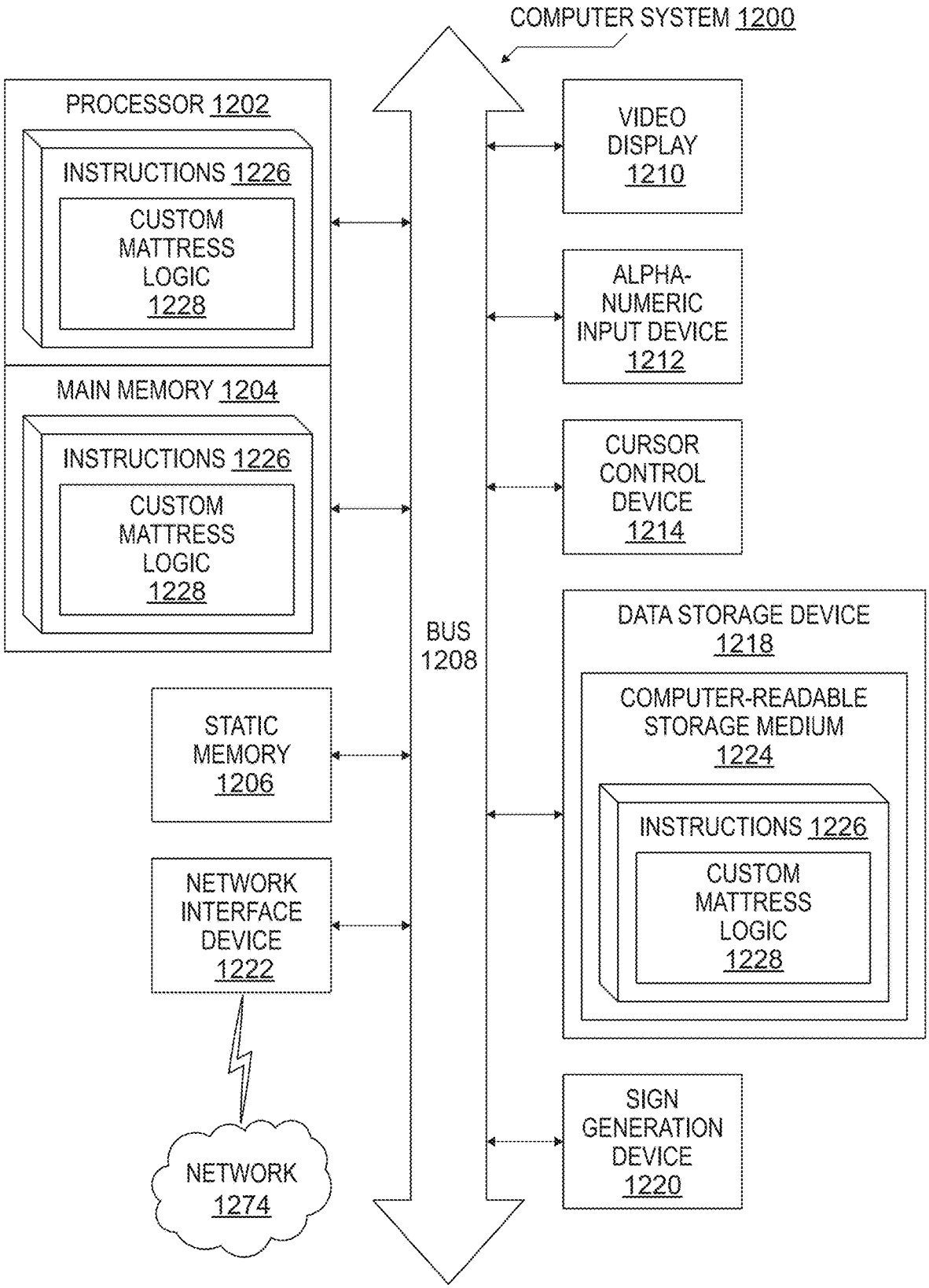
FIG. 16 is a block diagram illustrating an exemplary computer system, according to some implementations.

FIG. 16 illustrates a diagrammatic representation of a machine in the exemplary form of a computer system 1200 within which a set of instructions, for causing the machine to perform any one or more of the methodologies discussed herein, may be executed. In alternative implementations, the machine may be connected (e.g., networked) to other machines in a LAN, an intranet, an extranet, or the Internet. The machine may operate in the capacity of a server or a client machine in client-server network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 1200 includes a processing device (processor) 1202, a main memory 1204 (e.g., read-only memory (ROM), flash memory, dynamic random access memory (DRAM) such as synchronous DRAM (SDRAM) or Rambus DRAM (RDRAM), etc.), a static memory 1206 (e.g., flash memory, static random access memory (SRAM), etc.), and a data storage device 1218, which communicate with each other via a bus 1208.

Processing device 1202 represents one or more general-purpose processing devices such as a microprocessor, central processing unit, or the like. More particularly, the processing device 1202 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processing device 1202 may also be one or more special-purpose processing devices such as an application specific integrated circuit (ASIC), a field programmable gate array (FPGA), a digital signal processor (DSP), network processor, or the like. The processing device 1202 is configured to execute instructions 1226 for performing the operations and steps discussed herein.

The computer system 1200 may further include a network interface device 1222. The computer system 1200 also may include a video display unit (e.g., a liquid crystal display (LCD), a cathode ray tube (CRT), or a touch screen), an alphanumeric input device 1212 (e.g., a keyboard), a cursor control device 1214 (e.g., a mouse), and a signal generation device 1220 (e.g., a speaker).

The data storage device 1218 may include a computer-readable storage medium 1224 on which is stored one or more sets of instructions 1226 (e.g., software) embodying any one or more of the methodologies or functions described herein. The instructions 1226 may also reside, completely or at least partially, within the main memory 1204 and/or within the processing device 1202 during execution thereof by the computer system 1200, the main memory 1204 and the processing device 1202 also constituting computer-readable storage media. The instructions 1226 may further be transmitted or received over a network 1274 via the network interface device 1222.

In one implementation, the instructions 1226 include customized mattress logic 1228 for creating a customized mattress as described above. While the computer-readable storage medium 1224 is shown in an exemplary implementation to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to, solid-state memories, optical media, and magnetic media.

By distributing the adjustable test beds to various partner locations to serve as testing stations, the need for dedicated retail space is eliminated. The test beds can be installed anywhere a channel partner is willing to provide space, such as in kiosks, hotels, doctors' offices, etc. Once a user determines their ideal settings, the finalized configuration is transmitted to the factory for production and fulfillment. This enables a flexible, low-overhead business model for personalized mattress sales.

The outer walls 106 may optionally comprise at least one resilient material, such as foam, soft or flexible material, fiber, metal coil springs, pocket springs or other objects or materials that have spring like property is, or any combination of elements listed herein. For instance, one such embodiment may utilize a construction as described in U.S. Pat. No. 11,661,989 to Cesko et al., incorporated herein by reference as if fully rewritten. Nonetheless, alternative resilient materials capable of providing comparable spring-like characteristics are also suitable and may be used without deviating from the invention's scope. Regardless of the material selected, each outer wall 106 encompasses an interior cavity that houses an inflatable bladder.

In this manner, the adjustable hybrid element mattress system provides users the ability to test and optimize a mattress to their personal requirements, then order a custom mattress manufactured to their determined specifications. The simplified testing station approach enables a variety of commercial opportunities through an expanded network of channel partners.

2. Operation of the Preferred Embodiment

A consumer employing a user device 4102 wishes to purchase a mattress customized for his/her comfort by the online store and visits a website and/or an app. In order to anticipate the consumer's tactile experience, a central server system provides questions to the consumer via the user device. The consumer may view, via a display device, multiple customization options for the mattress provided by a first interface of the central server system.

The consumer provides input data via the user device 4102 in response to the multiple customization options to a second interface of the central server system 4104. In addition, the consumer may provide generalized consumer proportion dimension data based on the consumer's dimensions to the second interface via the user device and/or via an image generation server.

Based on the input data provided by the consumer, including generalized consumer proportional dimension data which may be provided by the consumer and/or by the image generation server (which obtains the data from photograph(s) of the consumer), the central server system 4104 obtains a mapping of the customized mattress from a storage device 4110. The consumer may view the mapping on the display device 4116 and select to order the customized mattress based on the mapping. The order for the customized mattress is provided by the central server system 4104 to a mattress production device via a network.

The mapping includes various layers of the mattress, with various types of hybrid foam springs and inflatable bladders 110 placed in corresponding ergonomic contoured configuration areas. Each type of hybrid element 104 may have a unique corresponding strength/firmness and/or density rating. The mattress production device then produces the customized mattress according to the mapping.

Alternatively, the consumer may visit a retail kiosk or other physical location equipped with an adjustable test mattress as described. The user lays on the adjustable simulation mattress 101 and, through manual controls and/or a connected computer interface, adjusts the firmness and contouring of the various zones of the mattress by changing the fluid pressure of the inflatable bladders in each hybrid element.

Once the consumer has settled on their preferred configuration, this is saved electronically and transmitted to the central server system. There it is processed to generate a mapping of a customized mattress matching the results of the consumer's testing session. This mapping is then transmitted to the mattress production device for manufacturing of the personalized mattress, which is then delivered to the consumer.

By combining the online ordering and customization process with the tactile feedback and assurance provided by the Adjustable Mattress System 100, the system enables consumers to purchase customized mattresses with confidence while still allowing the streamlined logistics of the online sales model. The adjustable test beds also enable a variety of additional commercial partnership opportunities beyond the traditional mattress retailer environment.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company, v. Hilton Davis Chemical,* 520 US 17 (1997) or *Festo Corp. v. Shoketsu Kinzoku Kogyo Kabushiki Co.,* 535 U.S. 722

(2002), or other similar caselaw or subsequent precedent should not be made if any future claims are added or amended subsequent to this Patent Application.

What is claimed is:

1. A customized mattress system comprising:

an array of hybrid elements, each hybrid element comprising:

a resilient outer wall defining a hollow interior cavity, wherein the outer wall is formed of at least one resilient material selected from a group comprising foam, soft material, flexible material, fiber, pocket springs, and other objects or materials having spring-like properties excluding metal coil springs; and an inflatable bladder disposed within the cavity, wherein the inflatable bladder is configured to be inflated with a fluid;

a control system for receiving user inputs and independently adjusting a fluid pressure or a fluid quantity of the inflatable bladder in each hybrid element, thereby adjusting the characteristics of each hybrid element;

wherein the hybrid elements are arranged into a plurality of zones within the mattress, each zone comprising one or more hybrid elements;

wherein the compression stress-strain characteristics of each zone can be independently customized by adjusting the fluid pressure in the inflatable bladders of the hybrid elements within that zone.

2. The customized mattress system of claim 1, wherein the control system is configured to:

receive user input indicating a desired characteristics for each zone;

determine a desired fluid pressure value or fluid quantity value for the inflatable bladder of each hybrid element to achieve the desired compression stress-strain characteristics for each zone;

generate control signals for the control system to:

set the fluid pressure of each inflatable bladder to the desired value;

output final approved characteristics configuration;

transmit final approved characteristics configuration to a manufacturing system for production of a non-adjustable mattress matching the customized compression stress-strain characteristics.

3. The customized mattress system of claim 2, wherein the customized stress-strain characteristics are selected from a group consisting of: firmness; softness; support; support factor, temperature regulation; moisture wicking; durability; and hypoallergenic properties.

4. The customized mattress system of claim 3, wherein the array of hybrid elements is comprised in a mattress, seat cushion, pillow or upholstered furniture cushion.

5. The customized mattress system of claim 2, wherein the array of hybrid elements is comprised in a mattress, seat cushion, pillow or upholstered furniture cushion.

6. The customized mattress system of claim 1, further comprising an interactive questionnaire for receiving initial user preferences and using the preferences to suggest an initial customized characteristics for each zone prior to or during user testing, and wherein initial customized compression stress-strain characteristics for each zone is determined by an algorithm or a neural network and based on the initial user preferences.

7. The customized mattress system of claim 6, wherein the array of hybrid elements is comprised in a mattress, seat cushion, pillow or upholstered furniture cushion.

8. The customized mattress system of claim 1, wherein the control system is further configured to receive generalized user body dimension data and utilize the dimension data in determining the customized compression stress-strain characteristics, and wherein the generalized user body dimension data is generated based on photographs of the user by an image analysis system.

9. The customized mattress system of claim 8, wherein the array of hybrid elements is comprised in a mattress, seat cushion, pillow or upholstered furniture cushion.

10. The customized mattress system of claim 1, wherein the resilient outer walls of the hybrid elements comprise foam material.

11. The customized mattress system of claim 10, wherein the array of hybrid elements is comprised in a mattress, seat cushion, pillow or upholstered furniture cushion.

12. The customized mattress system of claim 1, wherein the fluid pressure in the inflatable bladders is adjusted to simulate compression stress-strain characteristics of existing products.

13. The customized mattress system of claim 12, wherein the array of hybrid elements is comprised in a mattress, seat cushion, pillow or upholstered furniture cushion.

14. The customized mattress system of claim 1, further comprising a plurality of sensors, for detecting a user's body weight distribution on the mattress, and wherein the control system is configured to automatically adjust the pressure and/or volume of the inflatable bladders based on the detected body weight distribution to optimize comfort and support.

15. The customized mattress system of claim 14, wherein the array of hybrid elements is comprised in a mattress, seat cushion, pillow or upholstered furniture cushion.

16. The customized mattress system of claim 1, wherein the array of hybrid elements is comprised in a mattress, seat cushion, pillow or upholstered furniture cushion.

17. A customized mattress system, comprising:

an array of hybrid elements, each hybrid element comprising:

a resilient outer wall defining a hollow interior cavity, wherein the resilient outer wall is formed of at least foam material; and an inflatable bladder disposed within the cavity, wherein the inflatable bladder is configured to be inflated with a fluid;

a control system configured to receive user inputs and independently adjust a fluid pressure or a fluid quantity of the inflatable bladder in each hybrid element, thereby adjusting the characteristics of each hybrid element, wherein the hybrid elements are arranged into a plurality of zones within the mattress, each zone comprising one or more hybrid elements, wherein compression stress-strain characteristics of each zone are independently customizable, by adjusting the fluid pressure in the inflatable bladders of the hybrid elements within that zone.

18. The customized mattress system of claim 17, wherein the array of hybrid elements is comprised in a mattress, seat cushion, pillow or upholstered furniture cushion.

* * * * *